US011623160B2

(12) United States Patent
Jenner

(10) Patent No.: US 11,623,160 B2
(45) Date of Patent: Apr. 11, 2023

(54) SYSTEM FOR BUILDING A LOAD BEARING STRUCTURE

(71) Applicant: Jenner Innovation Pty Ltd, Karuah (AU)

(72) Inventor: Vaughan Mathew Jenner, Karuah (AU)

(73) Assignee: Jenner Innovation Pty Ltd, Karuah (AU)

( * ) Notice: Subject to any disclaimer, the term of this patent is extended or adjusted under 35 U.S.C. 154(b) by 114 days.

(21) Appl. No.: 16/647,097

(22) PCT Filed: Sep. 14, 2018

(86) PCT No.: PCT/AU2018/051004
§ 371 (c)(1),
(2) Date: Mar. 13, 2020

(87) PCT Pub. No.: WO2019/051555
PCT Pub. Date: Mar. 21, 2019

(65) Prior Publication Data

US 2020/0206647 A1 Jul. 2, 2020

(30) Foreign Application Priority Data

Sep. 14, 2017 (AU) ..... 2017903740

(51) Int. Cl.
*E04B 2/18* (2006.01)
*E04B 2/02* (2006.01)
(Continued)

(52) U.S. Cl.
CPC ..... *A63H 33/086* (2013.01); *E04B 2/08* (2013.01); *A63H 33/062* (2013.01);
(Continued)

(58) Field of Classification Search
CPC ..... E04B 2002/0206; E04B 2002/0208; E04B 2002/021; E04B 2002/0213;
(Continued)

(56) References Cited

U.S. PATENT DOCUMENTS 2,019,653 A * 11/1935 Buyer ..... E04B 2/16 52/592.5
2,201,110 A * 5/1940 Tewfik ..... E04B 2/42 D25/113
(Continued)

FOREIGN PATENT DOCUMENTS

BE 644857 A 7/1964
DE 2139967 A1 2/1973
(Continued)

OTHER PUBLICATIONS

English language abstract for WO2012056394A1 downloaded from espacenet.com database on Jun. 10, 2020, 1 page.
(Continued)

*Primary Examiner* — Kyle J. Walraed-Sullivan
(74) *Attorney, Agent, or Firm* — Howard & Howard Attorneys PLLC

(57) ABSTRACT

A system for building a load bearing structure for supporting a compressive load, the system including a plurality of wooden members; wherein a protrusion of a second member is locatable within a recess of a first or third member to interconnect the first and second or third and second members together to form the loading bearing structure, wherein the protrusion is not rotatable within the recess, and; wherein the third member has a recess with a depth greater than the height of the protrusion of the second member such that a cavity is formed between an upper inner wall of the third
(Continued)

member and a top portion of the protrusion of the second member when the second and third members are interconnected.

25 Claims, 21 Drawing Sheets

(51) Int. Cl.
*A63H 33/08* (2006.01)
*E04B 2/08* (2006.01)
*A63H 33/06* (2006.01)

(52) U.S. Cl.
CPC .... *A63H 33/084* (2013.01); *E04B 2002/0206* (2013.01); *E04B 2002/0208* (2013.01); *E04B 2002/0217* (2013.01)

(58) Field of Classification Search
CPC ..... E04B 2002/0215; E04B 2002/0217; E04B 2002/0219; E04B 2002/0221; E04B 2002/0223; E04B 2002/0226; E04B 2002/0228; E04B 2002/0243; E04B 2002/0245; E04B 2002/0232; E04B 2002/0239; E04B 2002/0241; A63H 33/06; A63H 33/062; A63H 33/08; A63H 33/082; A63H 33/084; A63H 33/086; A63H 33/088; A63H 33/101; A63H 33/105; A63H 33/108
USPC ..... 52/561, 604
See application file for complete search history.

(56) References Cited

U.S. PATENT DOCUMENTS 3,305,982 A * 2/1967 Steele ..... E04B 2/22 52/286
3,618,279 A * 11/1971 Sease ..... E04B 2/46 52/439
4,026,086 A * 5/1977 Langley ..... H01F 7/0252 52/592.6
4,031,678 A * 6/1977 Schuring ..... E04B 2/18 52/592.6
4,107,894 A * 8/1978 Mullins ..... E04B 2/18 52/592.6
4,262,463 A * 4/1981 Hapel ..... E04B 2/46 52/505
4,671,039 A * 6/1987 Hunt ..... E04B 2/18 52/562
5,181,362 A * 1/1993 Benitez ..... E04B 2/18 52/591.1
5,402,609 A * 4/1995 Kelley, Jr. ..... E04B 2/32 52/561
5,647,185 A * 7/1997 Forlini ..... E04B 2/06 52/607
5,832,687 A * 11/1998 Willemsen ..... E04B 2/08 52/603
5,934,037 A * 8/1999 Bundra ..... E04B 2/08 52/603
6,141,933 A * 11/2000 McClinton ..... B28B 11/044 52/591.1
6,758,020 B2 7/2004 Cerrato
7,946,090 B1 * 5/2011 Walters ..... E04C 1/40 52/309.7
8,382,398 B2 * 2/2013 Stauffacher ..... E02B 3/108 405/111
9,038,346 B1 * 5/2015 Wauhop ..... E04B 2/18 52/592.6
9,175,469 B2 * 11/2015 Toopchinezhad ..... E04B 2/24
10,781,588 B1 * 9/2020 Nadeau ..... E04C 5/163
10,907,350 B1 * 2/2021 Shillingburg ..... E04C 1/395
2001/0029719 A1 * 10/2001 Azar ..... E04B 2/06 52/592.1
2002/0043038 A1 * 4/2002 Cerrato ..... E04B 2/08 52/592.1
2002/0059769 A1 * 5/2002 Matsuda ..... E04B 2/06 52/605
2003/0029119 A1 * 2/2003 Coleman ..... E04B 2/08 52/592.6
2003/0070386 A1 * 4/2003 Hampton ..... E04C 1/395 52/561
2004/0020145 A1 * 2/2004 Matsufuji ..... E04B 2/42 52/223.7
2004/0065506 A1 * 4/2004 Salls ..... E04C 1/395 181/293
2004/0134154 A1 * 7/2004 Bott ..... E04C 1/395 52/561
2004/0159065 A1 * 8/2004 Burgess ..... E02D 29/025 52/574
2004/0163358 A1 * 8/2004 Clarke ..... E04C 3/12 52/782.1
2004/0226246 A1 * 11/2004 Doty ..... E04B 2/18 52/576
2005/0115185 A1 * 6/2005 Telford ..... E04F 13/02 52/596
2007/0006542 A1 * 1/2007 Duke ..... F41H 5/04 52/561
2007/0094989 A1 * 5/2007 Scheker ..... E04C 1/397 52/596
2008/0184649 A1 * 8/2008 Khan ..... E04B 2/06 52/592.6
2009/0077920 A1 * 3/2009 Korman ..... B29C 43/06 249/176
2009/0094917 A1 * 4/2009 McIntosh ..... E04C 1/395 52/603
2009/0113836 A1 * 5/2009 Pitchers ..... E04B 2/08 52/604
2009/0193740 A1 * 8/2009 Bennett ..... E04C 1/40 52/309.4
2009/0301028 A1 * 12/2009 Pfoff ..... E04B 2/06 52/741.11
2010/0192502 A1 * 8/2010 Mugge ..... E04C 1/395 52/561
2010/0223876 A1 * 9/2010 Jones ..... E04B 2/12 52/588.1
2010/0263310 A1 * 10/2010 Wauhop ..... E04C 1/395 52/250
2011/0021107 A1 * 1/2011 Nag ..... A63H 33/042 446/91
2012/0151862 A1 * 6/2012 Daoust ..... E04C 1/395 52/569
2013/0036696 A1 * 2/2013 Moroschan ..... E04C 1/41 52/745.1
2013/0036700 A1 * 2/2013 Speer ..... E04C 1/00 52/745.1
2013/0227901 A1 * 9/2013 Zohar ..... E04C 1/397 52/561
2015/0159371 A1 * 6/2015 Rodriguez Carassus ..... E04B 2/44 52/204.2
2015/0259125 A1 * 9/2015 Breaz ..... B65D 90/024 220/592.2
2015/0292206 A1 * 10/2015 Frederickx ..... E02D 29/025 52/604
2015/0300006 A1 * 10/2015 Lanese ..... E04B 2/06 52/745.1
2016/0090705 A1 * 3/2016 Scherkl ..... E02B 3/106 405/116
2016/0108614 A1 * 4/2016 Munz ..... E04B 2/02 52/604
2016/0194874 A1 * 7/2016 Radford ..... E04B 7/22 29/897.34
2016/0346707 A1 * 12/2016 Kuo ..... E04B 2/12
2017/0159288 A1 * 6/2017 Leon Ramirez ..... E04B 2/18
2018/0266105 A1 * 9/2018 Rodriguez Carassus ..... E04B 2/18
2019/0193298 A1 * 6/2019 Chan ..... C04B 33/34

(56) References Cited

U.S. PATENT DOCUMENTS

| | | | | |
|---|---|---|---|---|
| 2019/0257080 | A1* | 8/2019 | Harris | E04B 2/08 |
| 2021/0156147 | A1* | 5/2021 | Fermanian | E04C 1/41 |
| 2021/0207336 | A1* | 7/2021 | Castonguay | E04C 1/395 |
| 2021/0238846 | A1* | 8/2021 | Zhang | E04B 2/32 |

FOREIGN PATENT DOCUMENTS

| | | | |
|---|---|---|---|
| WO | 2012020229 | A1 | 2/2012 |
| WO | 2012056394 | A1 | 5/2012 |
| WO | 2013078732 | A1 | 6/2013 |

OTHER PUBLICATIONS

English language abstract for WO2013078732A1 downloaded from espacenet.com database on Jun. 10, 2020, 1 page.
International Search Report dated Nov. 26, 2018 from corresponding International Application No. PCT/AU2018/051004, 5 pages.
Partial machine-assisted English translation for BE 644 857 A extracted from the espacenet.com database on Sep. 5, 2022, 7 pages.
Machine-assisted English translation for DE 21 39 967 A1 extracted from the espacenet.com database on Sep. 5, 2022, 7 pages.

* cited by examiner

SYSTEM FOR BUILDING A LOAD BEARING STRUCTURE

CROSS-REFERENCE TO RELATED APPLICATIONS

This application is the National Stage of International Patent Application No. PCT/AU2018/051004 filed on Sep. 14, 2018, which claims priority to and all the advantages of Australian Patent Application No. 2017903740 filed on Sep. 14, 2017. The entire contents of these applications are incorporated herein by reference in their entirety.

FIELD OF INVENTION

The present invention relates to a system for building load bearing structures using wooden members.

BACKGROUND

It is necessary in a range of industries to build temporary load bearing structures to support a compressive load. For example, in the field of underground mining, these structures are used to provide secondary support to a portion of the mine. In this situation, the major structural support is provided by in-situ rock pillars in the mine which converge under loading. Accordingly, the secondary supports must be able to accommodate this convergence as well as provide a high level of support.

A common choice of material for these structures is timber, as it provides the high capacity for compressive loading required while also featuring a lower elastic modulus than other engineering materials with suitable loading capacities. The lower modulus allows timber built structures to more easily accommodate the convergences that occur. Additionally, load-bearing structures made from the other materials such as welded steel or concrete bricks and mortar are typically more costly to construct and harder to relocate and reuse.

Timber load bearing structures are typically made of wooden members fastened together using traditional fastening means such as nails, screws and bolts. In other instances, these wooden members may be stacked upon one another without fastening between the stacked members in order to support the compressive load. However, these structures do not support any substantial lateral force component and thus can fail in such situations. Furthermore, in some instances, it can be difficult to identify that the load bearing structure may be nearing failure as there are no obvious visual indicators. Thus, the temporary load bearing structure may be left in place until full failure is reached which can be dangerous.

Compounding this problem is the tendency of these timber structures to fail in an unpredictable manner. The geometry of a timber member may change as it begins to yield, introducing force components in directions other than the initial loading direction. This can cause other members to undergo greater loading than expected, causing the structure to fail prematurely. Thus, it is hard to anticipate when and where on the structure failure will occur.

U.S. Pat. No. 6,758,020 B2 describes a masonry wall system that overcomes some of these problems by avoiding the use of timber and providing a concrete block system that does not require mortar, allowing comparatively easier installation than for conventional brick and mortar systems. The system is composed of straight and corner shaped masonry blocks with interlocking structures and corresponding mating surfaces as well as stabilizing holes through which reinforcing rods are placed. Each block is allowed to move a small amount relative to the reinforcing rods and other blocks. This allows this system to withstand higher lateral forces than otherwise would be possible, as the force is transferred into the surrounding blocks rather than being concentrated in a single block. The system however, does not feature any visual indicators for when the system is approaching failure, nor is it possible to predict where on the structure failure will occur. The use of concrete is also still more expensive than using wood for the structure, and does not provide the required lower modulus in situations like underground mining.

A system using wooden members is disclosed in US 2004/0163358 A1. This system relates to the construction of log structures such as houses, and similarly discloses corner structures and straight sections connected using tapered joints and v-groove surfaces. This system however, does not feature any visual indicators for when the system is approaching failure nor is it easy to predict where in the structure failure will occur.

WO 2012/056394 A1 describes a system featuring plastic or plastic-coated wood members with interlocking structures which are connected to form structures for use in the construction industry, such as walls or houses. No visual indicators for when the system is approaching failure are present, nor predictors of where in the structure failure will occur.

Additionally, the systems described above refer to wall structures and as such are not suited to load bearing structures where an arch is required. Commonly, arches are used to transfer load from the centre of the arch to the ends. These arches are typically preformed over a die to a predetermined angle off-site. This limits their applications and lowers the efficiency of transportation of such elements.

Therefore, there is a need to alleviate one or more of the above mentioned problems or provide a useful alternative.

SUMMARY

In one aspect there is provided a system for building a load bearing structure for supporting a compressive load, the system including:

a first member including first body having a recess therein; and a second member including a second body having protrusion extending therefrom;

wherein the protrusion of the second member is locatable within the recess of the first member to interconnect the first and second members together to form the loading bearing structure, wherein the protrusion is not rotatable within the hole and wherein the first and second members are wooden.

In another aspect, there is provided a system for building a load bearing structure for supporting a compressive load, the system including a plurality of wooden members including:

- a first member including a first body having a recess therein;
- a second member including a second body having protrusion extending therefrom; and
- a third member including a third body having a recess therein;
  - wherein the protrusion of the second member is locatable within the recess of the first or third member to interconnect the first and second or third and second members together to form the loading bearing structure, wherein the protrusion is not rotatable within the recess, and;

wherein the third member has a recess with a depth greater than the height of the protrusion of the second member such that a cavity is formed between an upper inner wall of the third member and a top portion of the protrusion of the second member when the second and third members are interconnected.

In some embodiments, the first body has extending therefor a protrusion, and the second body includes a recess.

In some embodiments, the protrusion of the first body extends in a direction substantially parallel to the longitudinal axis of the hole.

In some embodiments, the recess of the second body extends in a direction substantially parallel to a direction which the protrusion extends from the second body.

In some embodiments, a top portion of the protrusion of the first and second member includes a hole extending therethrough to the respective recess to allow a fastener to fasten the first member to the second member via aligned holes when the first and second member are interconnected.

In some embodiments, the protrusion of the second member extends from a face of the body which is not substantially parallel relative to the axis of the respective recess.

In some embodiments, one or more side walls of the protrusion of the second member include a ridge and wherein one or more inner side walls of the recess include a notch, wherein the ridge is engaged within the notch when the protrusion of the second member is located within the recess of the first member to secure the first and second wooden components together.

In some embodiments, the load bearing structure includes a cavity located between an upper inner wall of the hole of the third member and a top portion of the protrusion of the second member when the third and second wooden members are interconnected, wherein the cavity enables monitoring of a dimension of the interconnected members under load to determine if the load bearing structure is sufficient for supporting the load.

In some embodiments, the protrusion of the second member and the recess of the first member have a substantially quadrilateral cross-sectional profile.

In some embodiments, the quadrilateral cross-sectional profile is a substantially square profile.

In some embodiments, there is provided a side hole in a side wall of the first body to enable a fastener to protrude through the side hole and into the protrusion of the second member received within the recess of the first body to thereby secure the first wooden member to the second wooden member.

In some embodiments, a height of the protrusion of the second member is approximately half a height of the second body.

In some embodiments, a depth of the recess of the first member is approximately half a height of the first body.

In some embodiments, an outer side of the first or second member includes a T-slot interface to enable interlocking with a further member having a corresponding T-slot interface.

In some embodiments, the second member further includes a further protrusion, wherein the further protrusion includes a circular cross-sectional profile to be received within a recess of an additional wooden member, wherein the additional wooden member is pivotable relative to the second member due to the further protrusion being able to rotate within the recess of the additional wooden member.

In some embodiments, the body of the second member includes a hole passing therethrough to allow a pin to join the second member to another structure.

In some embodiments, the first body or second body include a ramped face.

In some embodiments, the first body includes a further recess extending therein in a direction orthogonal to the recess.

In some embodiments, the second body includes a further projection extending in a direction orthogonal to the projection.

In some embodiments, the body of the first wooden member and the body of the second wooden member are elongate, wherein the first body includes a plurality of recesses extending therein in a common direction, and wherein the body of the second member includes a plurality of protrusions extending from the second body in a common direction.

In some embodiments, the system includes a metal stiffener sheet which includes a plurality of holes to receive therethrough the plurality of protrusions of the second member prior to being interconnected with the first member, wherein the metal stiffener sheet is sandwiched between the first and second bodies.

In some embodiments, the body of at least one of the first and second members includes a dog-leg profile.

In some embodiments, at least one of the protrusions of the second member includes a dog-leg cross-sectional profile and wherein at least one of the recesses of the first member includes a corresponding dog-leg profile.

In some embodiments, the body of the first and second wooden members has an arc-profile.

In some embodiments, the first member is elongate and includes a plurality of protrusions extending from the first body, and wherein the second member is elongate and includes a plurality of recesses extending within the second body, wherein the spacing between neighbouring protrusions is substantially equal, wherein the spacing between neighbouring recesses is substantially equal, wherein the spacing between protrusions is different to the spacing between recesses, wherein the first and second bodies are flexible to align the plurality of protrusions with the plurality of recesses so as to allow the protrusions to be locatable with in the recesses and form the load bearing structure having an arched profile.

In some embodiments, the plurality of protrusions and the plurality of recesses have a dove-tail profile.

Other aspects and embodiments will be realised throughout the detailed description.

BRIEF DESCRIPTION OF THE FIGURES

Example embodiments should become apparent from the following description, which is given by way of example only, of at least one preferred but non-limiting embodiment, described in connection with the accompanying figures.

DESCRIPTION OF THE PREFERRED EMBODIMENTS

Figure 1A:
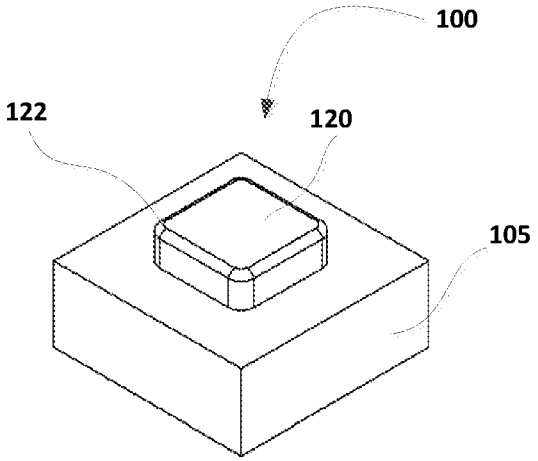
FIG. 1A is an isometric view of an example of a load bearing member.

The following modes, given by way of example only, are described in order to provide a more precise understanding of the subject matter of a preferred embodiment or embodiments. In the figures, incorporated to illustrate features of an example embodiment, like reference numerals are used to identify like parts throughout the figures.

Referring to the figures there is shown a system for building a load bearing structure 400 for supporting a compressive load. The system generally includes a plurality of load bearing members 100 that can be interconnected. A first load bearing member 100A of the plurality of members can include a first body 105 having a recess 110 therein. A second load bearing member 100B of the plurality of members can include a second body 105 having protrusion 120 extending therefrom. The protrusion 120 of the second load bearing member 100A is locatable within the recess 110 of the first load bearing member 100A to interconnect the first and second load bearing members 100A, 100B together to form the loading bearing structure 400. The protrusion 120 is not rotatable within the recess 110.

The first and second members 100A, 100B are wooden. This has several advantages over other standard engineering materials.

a. Value: Timber provides a very high cost to load ratio. One of the closest substitutes is RHS steel. The cost differential of RHS steel to hardwood is in the order of 10:1. The value is even higher again given the fact the steel sections are hollow and therefore they are only modular in the size of the section and the length. The hollow sections are also not as capable in regards to eccentric loading.

b. Modularity: Timber is a very flexible material. It can be cut, drilled, fastened to and chiseled with hand tools. This allows the structure to be customised on site at the time of need. This allows different loads and bearing conditions to be accommodated.

c. Stiffness: Timber has a much lower modulus of elasticity than other compressive materials such as steel or concrete. The lower stiffness allows timber to be able to protect interaction points of loads applied. A machined shaft or alike could be supported with a much lower chance of damage than the use of steel or concrete.

Figure 1B:
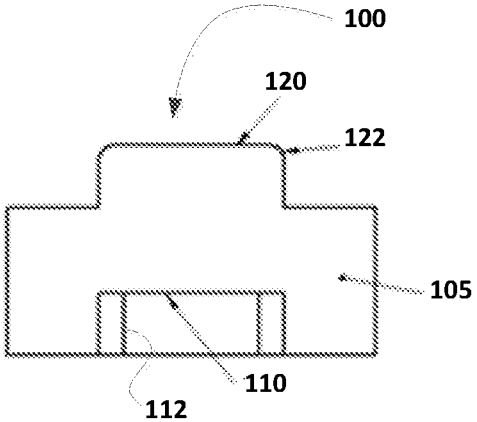
FIG. 1B is a cross-sectional view of the load bearing member of FIG. 1A.

Referring to FIG. 1B, the first and second load bearing members 100A, 100B can be similarly constructed. In particular, the first body 105 has extending therefrom a protrusion 120, and the second body 105 includes a recess 110. Therefore, each load bearing member 100 includes a protrusion 120 and a recess 110 to connect with another member including a respective protrusion and recess.

Figure 2:
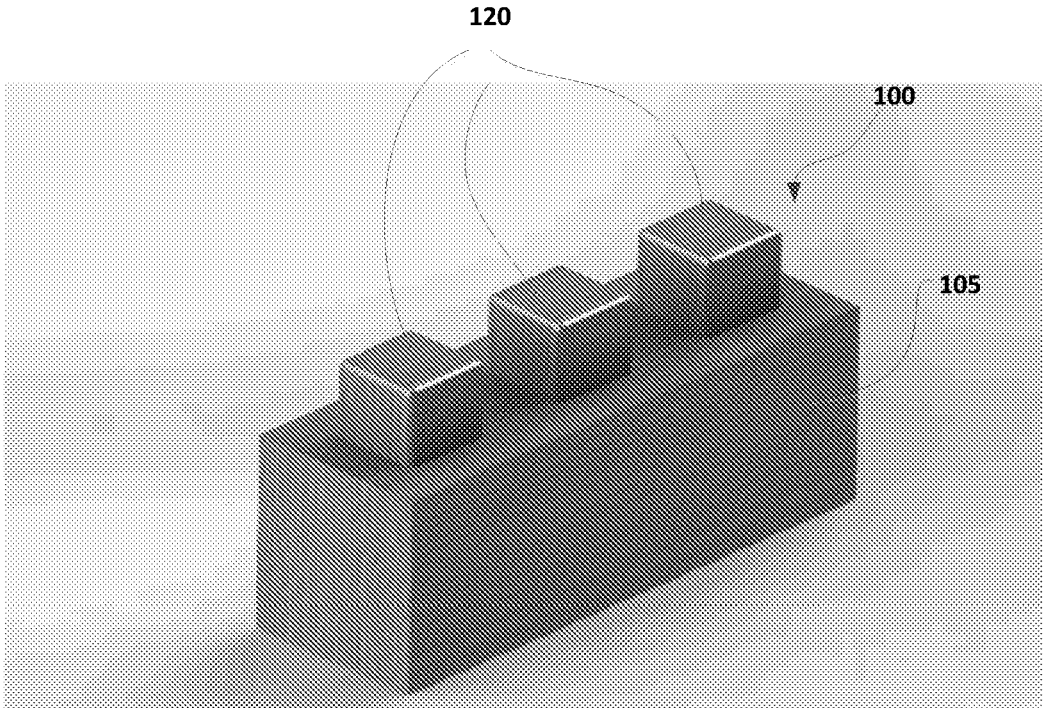
FIG. 2 is an isometric view of another example of a load bearing member including a plurality of protrusions.
Figure 3A:
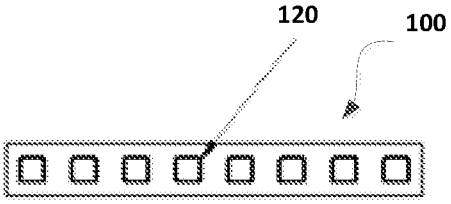
FIG. 3A is a plan view of a further example of a load bearing member.
Figure 3B:
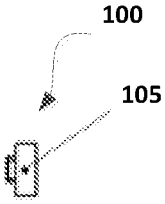
FIG. 3B is an end view of the load bearing member of FIG. 3A.
Figure 3C:
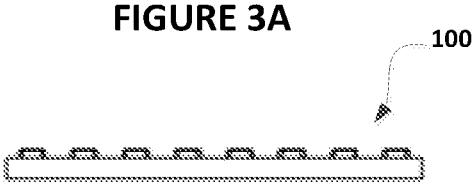
FIG. 3C is a side view of the load bearing member of FIG. 3A.
Figure 3D:
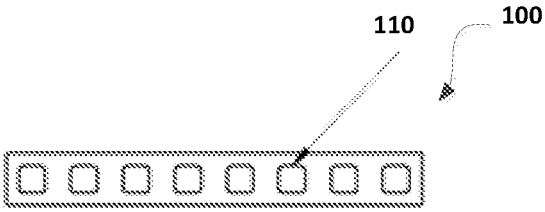
FIG. 3D is an underside view of the load bearing member of FIG. 3A.
Figure 3E:
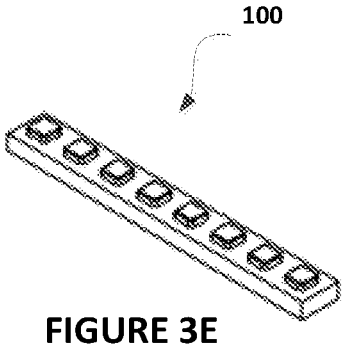
FIG. 3E is an isometric view of the load bearing member of FIG. 3A.

As shown in a number of the figures, for example, FIG. 2, the body 105 of the load bearing member 100 can be elongate. The elongate body 105 can include a plurality of recesses 110 extending within the body 105 in a common direction. Furthermore, the elongate body 105 can include a plurality of protrusions 120 extending from the body in a common direction.

Figure 33:
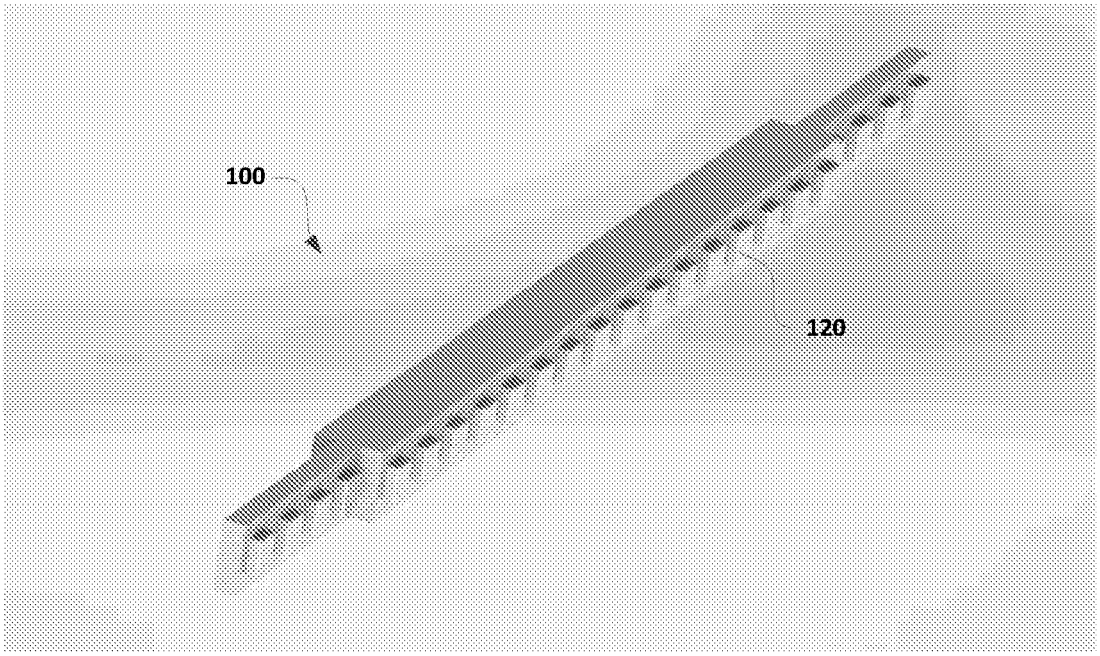
FIG. 33 is a perspective view of a plurality of load bearing members assembled to construct a laminated beam.

The protrusion 120 can include a substantially quadrilateral cross-sectional profile, such as a substantially square profile. Due to the square profile, the protrusion 120 is unable to rotate within the recess 110. However, as shown in FIG. 33 which shows a plurality of load bearing members assembled together to construct a limited beam, there is shown another example where the load bearing members 100 include one or more rectangular protrusions 120. A similar profile is provided on the opposing face of the body which provides the plurality of rectangular profiled recesses 110. Again, the rectangular protrusion 120 does not rotate within the rectangular recess 110. As shown in FIG. 1B, the protrusion 120 can have a chamfer or fillet 122 at the meeting between faces to provide for ease of assembly. Similarly, the recess 110 of the load bearing member can include a chamfer or fillet 112 at the meeting between walls of the recess to provide for ease of assembly.

In alternate embodiments as shown in FIGS. 7A, 7B, 7C and 7D and FIGS. 8A, 8B, 8C and 8D, a load bearing member 100 may only include one or more protrusions 120 (i.e. no recesses) or only include one or more recesses 110 (i.e. no protrusions). In FIGS. 7A, 7B, 7C and 7D, a first face of the body 105 has extending therefrom a plurality of protrusions 120 and a second opposing face of the body 105 is a planar flat surface 170. In FIGS. 8A, 8B, 8C and 8D, an underside face of the body has a plurality of recesses 110 and an opposing top face of the body is a planar flat surface 180. These types of load bearing members 100 can be advantageous in particular applications where a planar upper or lower surface is required for the load bearing structure. In one form, an adhesive layer, such as epoxy infused with media is applied to the planar surface. This allows the load bearing members 100 to provide a higher level of grip for ground consolidation applications As shown in FIG. 1B, the height of the protrusion 120 can be approximately half a height of the body 105. Additionally, as shown in FIG. 1B the depth of the recess 110 of the member 100 is approximately half a height of the body 105. However, the specific height and depth of the protrusion 120 can be customised depending upon the application. If the application requires resistance to moment, a larger height to width ratio piece would be used. The larger width to height ratio would provide for a larger protrusion 120 and recess 110. However, in other instances, the protrusions 120 and recess 110 could be less. For example, as shown in FIGS. 10A, 10B, 10C, 10D and 10E the protrusions 120 can be relatively thin compared to the arrangement shown in FIGS. 9A, 9B, 9C and 9D. However, in certain applications, a thicker body 105 is required as shown in FIGS. 11A, 11B, 11C, 11D, and 11E. In these embodiments, the ratios of the body 105, the recesses 110 and the protrusions 120 may not be the same as that earlier described.

Figure 5:
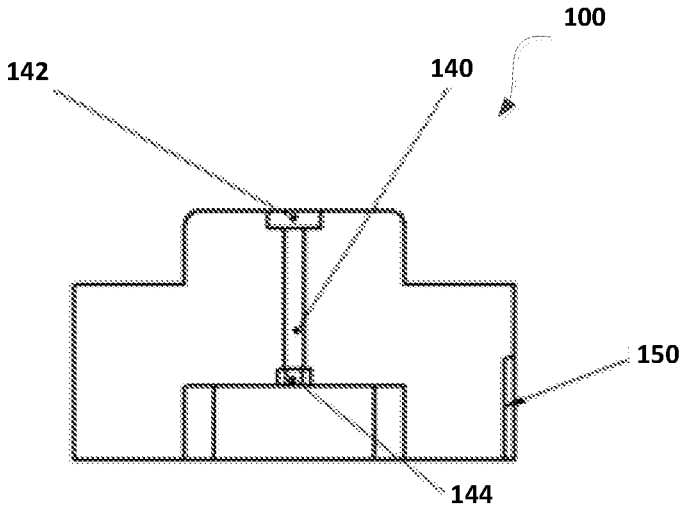
FIG. 5 is a cross-sectional view of a further example of a load bearing member having a fastener hole extending from the protrusion to the recess.
Figure 6A:
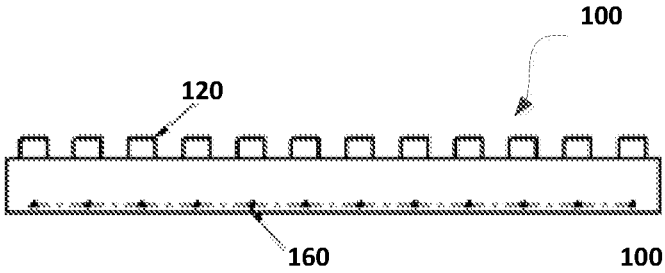
FIG. 6A is a side view of a further example of a load bearing member including a plurality of holes in the side wall of the body to secure the load bearing member to another load bearing member.
Figure 6B:
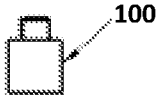
FIG. 6B is an end view of the load bearing member of FIG. 6A.
Figure 6C:
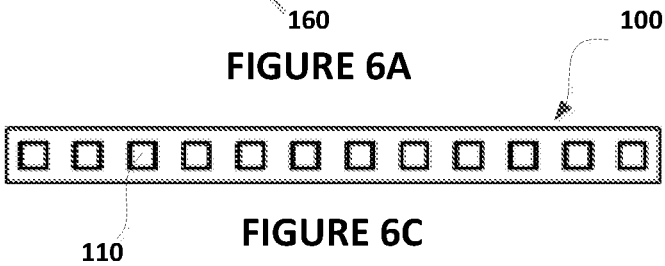
FIG. 6C is a plan view of the load bearing member of FIG. 6A.
Figure 6D:
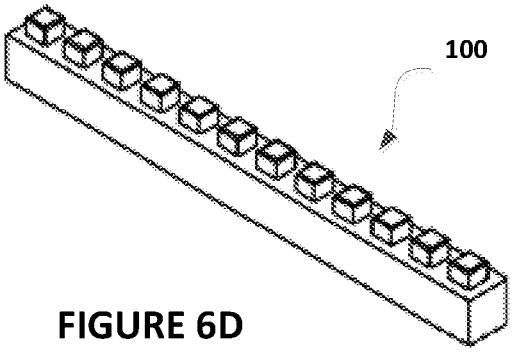
FIG. 6D is an isometric view of the load bearing member of FIG. 6A.
Figure 6E:
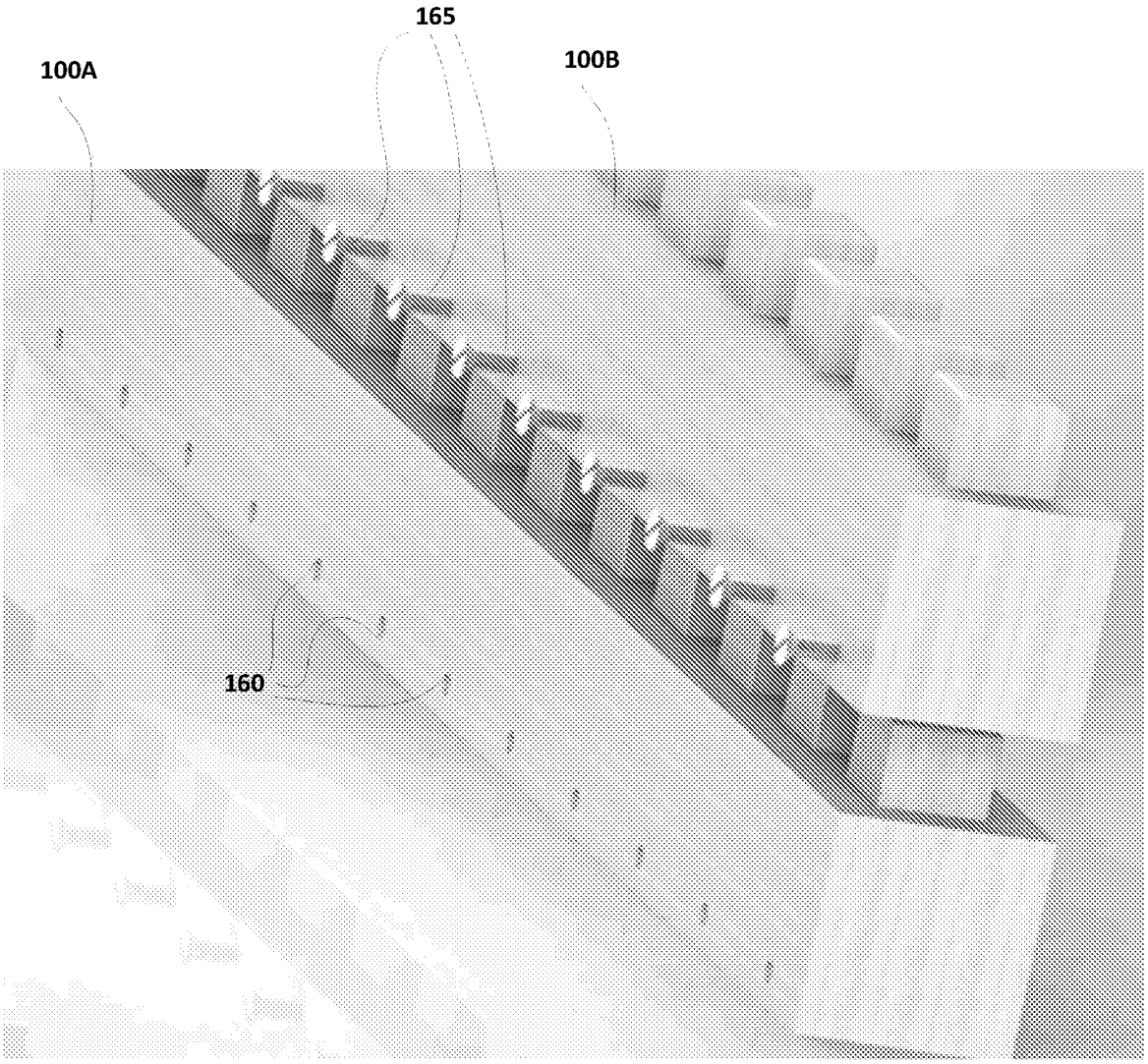
FIG. 6E is a perspective view of portions of a first and second load bearing members, having a plurality of holes provided in the side walls, being interconnected together.
Figure 7A:
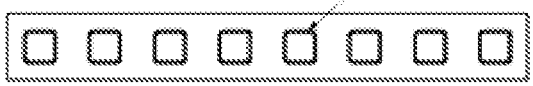
FIG. 7A is a plan view of a further example of a load bearing member.
Figure 7B:
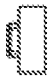
FIG. 7B is an end view of the load bearing member of FIG. 7A.
Figure 7C:
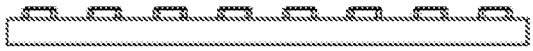
FIG. 7C is a side view of the load bearing member of FIG. 7A.
Figure 7D:
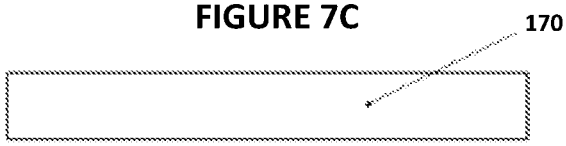
FIG. 7D is an underside view of the load bearing member of FIG. 7A.
Figure 7E:
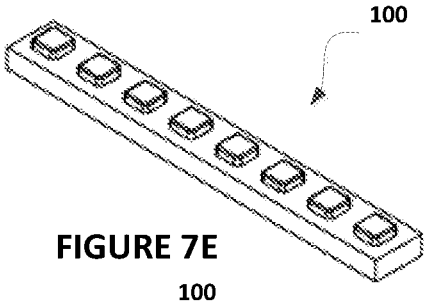
FIG. 7E is an isometric view of the load bearing member of FIG. 7A.
Figure 8A:
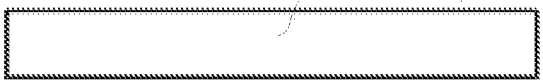
FIG. 8A is an plan view of a further example of a load bearing member.
Figure 8B:
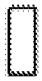
FIG. 8B is an end view of the load bearing member of FIG. 8A.
Figure 8C:
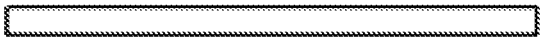
FIG. 8C is a side view of the load bearing member of FIG. 8A.
Figure 8D:
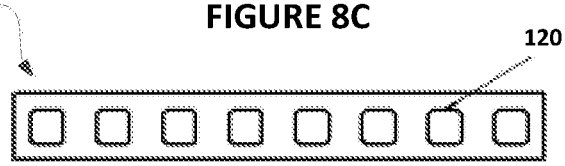
FIG. 8D is an underside view of the load bearing member of FIG. 8A.
Figure 8E:
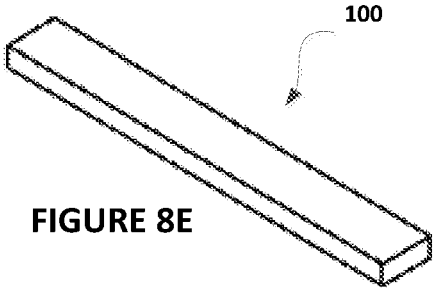
FIG. 8E is an isometric view of the load bearing member of FIG. 8A.
Figure 9A:
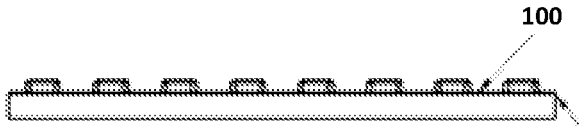
FIG. 9A is a side view of a further example of the load bearing member.
Figure 9B:
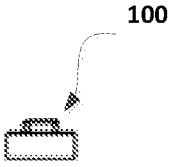
FIG. 9B is an end view of the load bearing member of FIG. 9A.
Figure 9C:
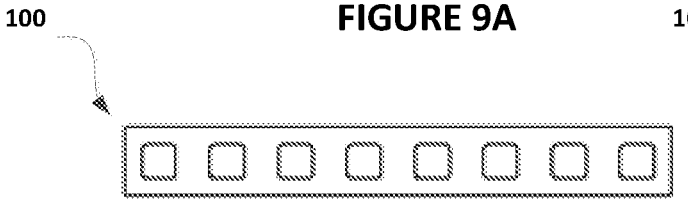
FIG. 9C is a plan view of the load bearing member of FIG. 9A.
Figure 9D:
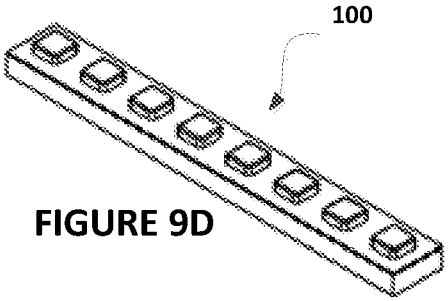
FIG. 9D is an isometric view of the load bearing member of FIG. 9A.
Figure 10A:
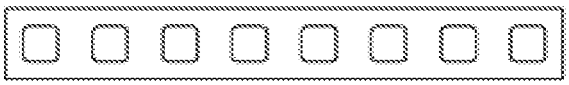
FIG. 10A is a plan view of a further example of a load bearing member.
Figure 10B:
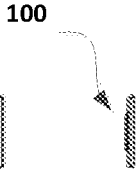
FIG. 10B is an end view of the load bearing member of FIG. 10A.
Figure 10C:
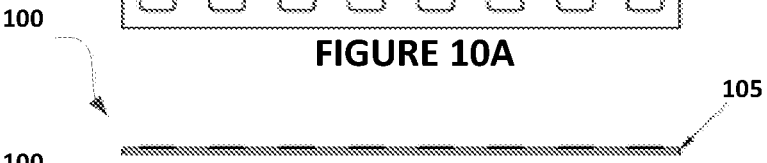
FIG. 10C is a side view of the load bearing member of FIG. 10A.
Figure 10D:
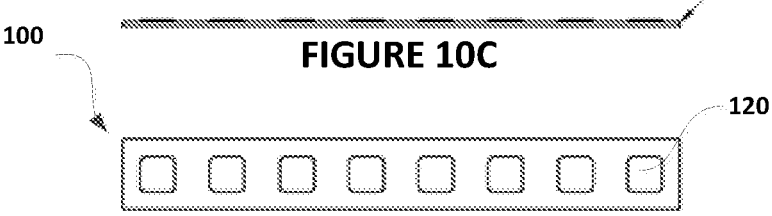
FIG. 10D is an underside view of the load bearing member of FIG. 10A.
Figure 10E:
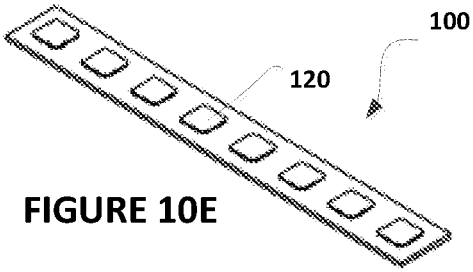
FIG. 10E is an isometric view of the load bearing member of FIG. 10A.
Figure 11A:
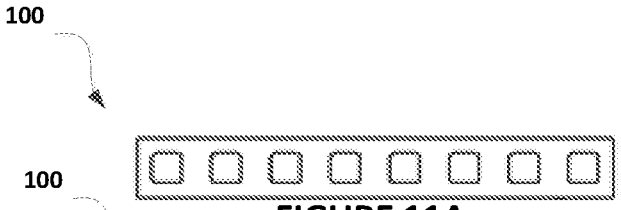
FIG. 11A is a plan view of a further example of a load bearing member.
Figure 11B:
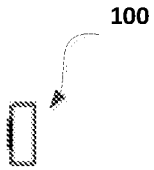
FIG. 11B is an end view of the load bearing member of FIG. 11A.
Figure 11C:
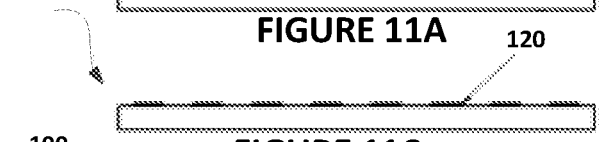
FIG. 11C is a side view of the load bearing member of FIG. 11A.
Figure 11D:
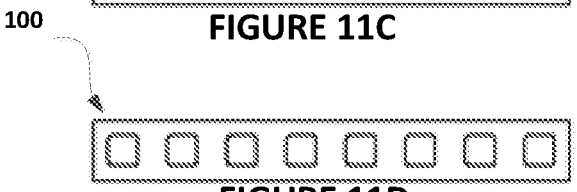
FIG. 11D is an underside view of the load bearing member of FIG. 11A.
Figure 11E:
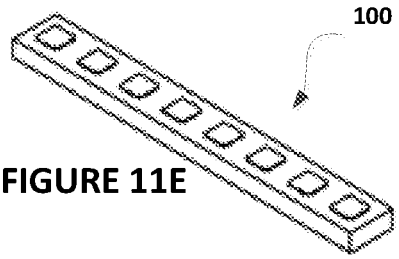
FIG. 11E is an isometric view of the load bearing member of FIG. 11A.
Figure 12A:
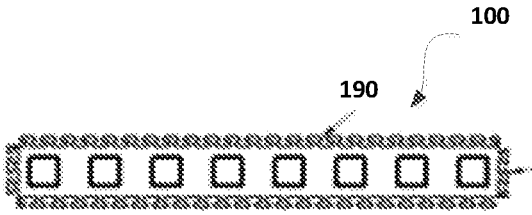
FIG. 12A is a plan view of a further example of a load bearing member.
Figure 12B:
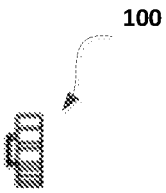
FIG. 12B is an end view of the load bearing member of FIG. 12A.
Figure 12C:
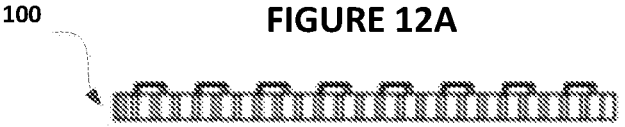
FIG. 12C is a side view of the load bearing member of FIG. 12A.
Figure 12D:
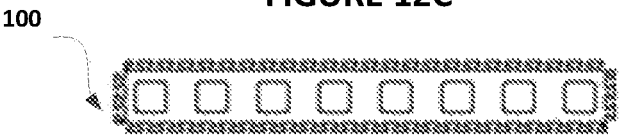
FIG. 12D is an underside view of the load bearing member of FIG. 12A.
Figure 12E:
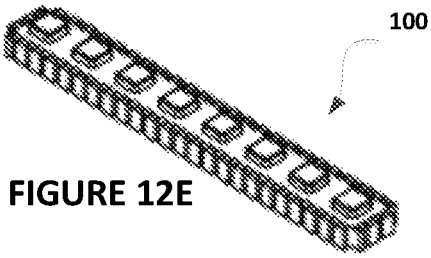
FIG. 12E is an isometric view of the load bearing member of FIG. 12A.
Figure 12F:
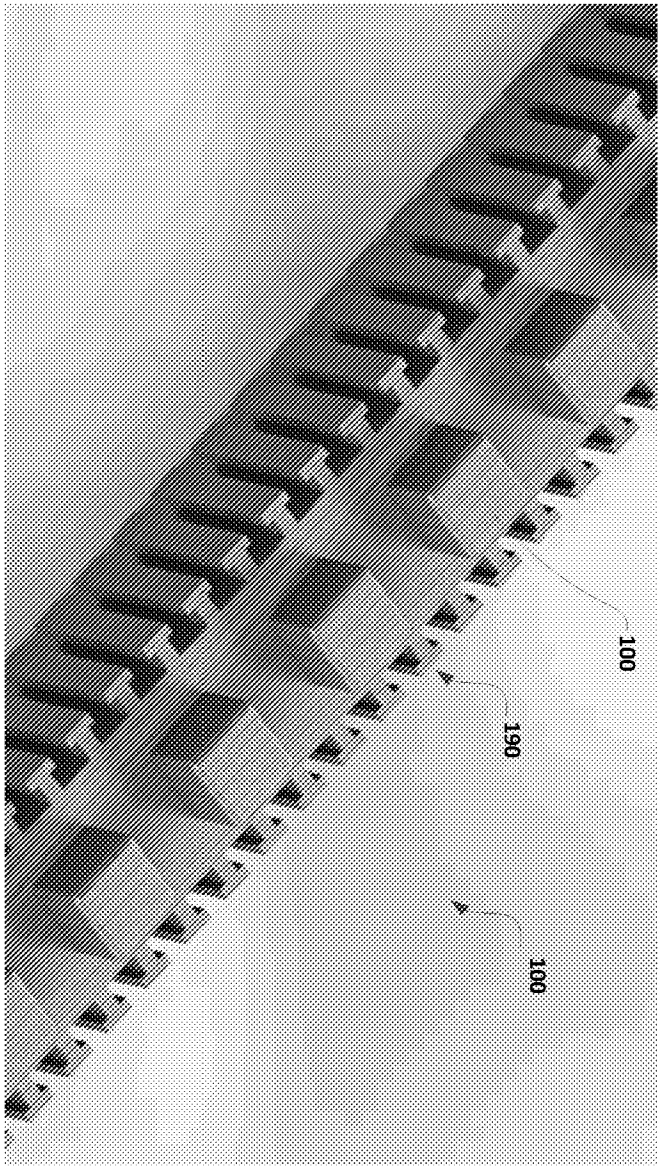
FIG. 12F is an isometric view of a magnified portion of the load bearing member of FIG. 12A.

Referring to FIG. 5, a top portion of the protrusion 120 of the load bearing member 100 includes a pre-drilled hole extending therethrough to the respective recess to allow a fastener to fasten the interconnecting load bearing members 100 via aligned holes 140. As shown in FIG. 5, the ends 142, 144 of the hole 140 are wider to accommodate specific types of fasteners. Fasteners can include bolts, pins, nails or screws to fasten the load bearing members together as shown in FIG. 6E. The holes 140 would allow the operator to quickly and accurately fix the pieces together at an optimum vertical point. The use of these fasteners also increases the load able to be supported by connected load bearing members 100 leading to a larger friction bond between the load bearing members 100 and a stiffer load bearing structure 400.

Continuing to refer to FIG. 5, the body 105 can include in one of the side walls a thin side recess 150 for a nail plate. This allows for a quick and accurate application of outside tensile connectors while still maintaining the modular building ability of the load bearing members 100.

Referring to FIGS. 6A, 6B, 6C and 6D, the load bearing member 100 includes one or more side holes 160 in a side wall of the body 105 to enable a fastener 165 to protrude through each side hole and into the respective protrusion 120 of the connecting member 100 received within the respective recess 110 to thereby secure the load bearing members 100 together. Fasteners 165 can include bolts, pins, nails or screws to fasten the load bearing members together as shown in FIG. 6E. The holes 160 would allow the operator to quickly and accurately fix the pieces together at an optimum horizontal point. The use of these fasteners 165 also increases the load able to be supported by connected load bearing members 100 leading to a larger friction bond between the load bearing members 100 and a stiffer load bearing structure 400.

Referring to FIGS. 12A, 12B, 12C, 12D, 12E and 12F an outer side of the load bearing member 100 includes a T-slot interface 190 to enable interlocking with a further load bearing member 100 having a corresponding T-slot interface 190. As shown in the relevant figures, the T-slot interface 190 can be provided on all side interfaces in order to allow the further load bearing member 100 to be connected to any of the side interfaces of the load bearing member 100. Each T member extends from the upper face to the lower face of the body of the load bearing member 100. The T-slot interface 190 is advantageous due to reducing shear planes that occur between adjacent load bearing members 100.

Figure 13A:
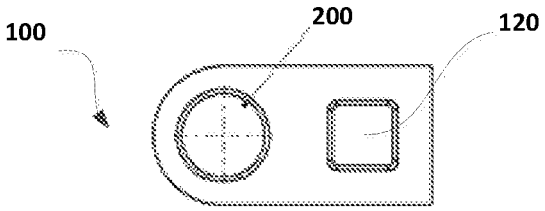
FIG. 13A is a plan view of a further example of a load bearing member.
Figure 13B:
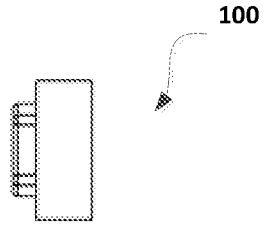
FIG. 13B is an end view of the load bearing member of FIG. 13A.
Figure 13C:
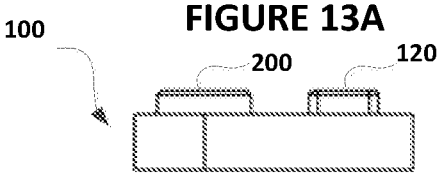
FIG. 13C is a side view of the load bearing member of FIG. 13A.
Figure 13D:
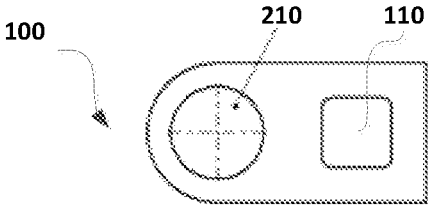
FIG. 13D is an underside view of the load bearing member of FIG. 13A.
Figure 13E:
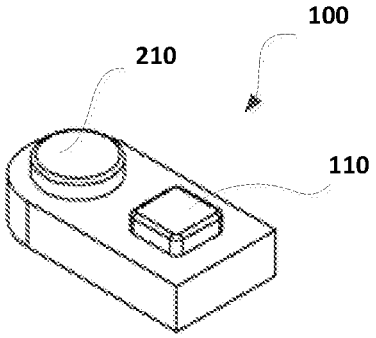
FIG. 13E is an isometric view of the load bearing member of FIG. 13A.
Figure 14A:
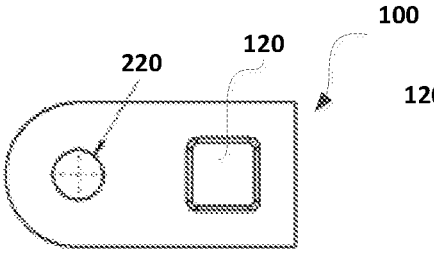
FIG. 14A is a plan view of a further example of a load bearing member.
Figure 14B:
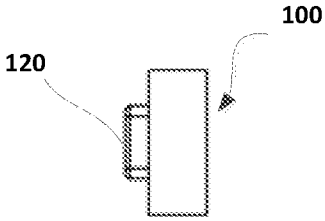
FIG. 14B is an end view of the load bearing member of FIG. 14A.
Figure 14C:
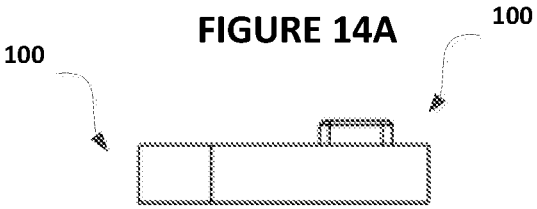
FIG. 14C is a side view of the load bearing member of FIG. 14A.
Figure 14D:
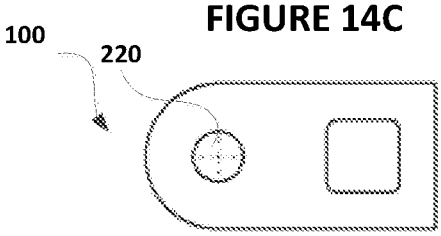
FIG. 14D is an underside view of the load bearing member of FIG. 14A.
Figure 14E:
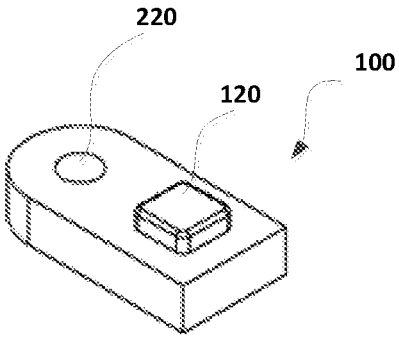
FIG. 14E is an isometric view of the load bearing member of FIG. 14A.
Figure 15A:
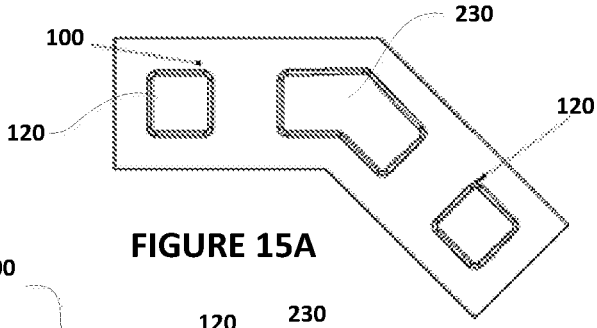
FIG. 15A is a plan view of a further example of a load bearing member.
Figure 15B:
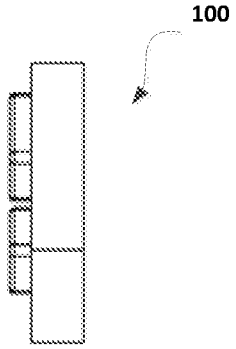
FIG. 15B is a first side view of the load bearing member of FIG. 15A.
Figure 15C:
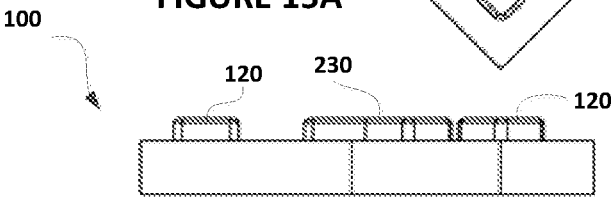
FIG. 15C is a second side view of the load bearing member of FIG. 15A.
Figure 15D:
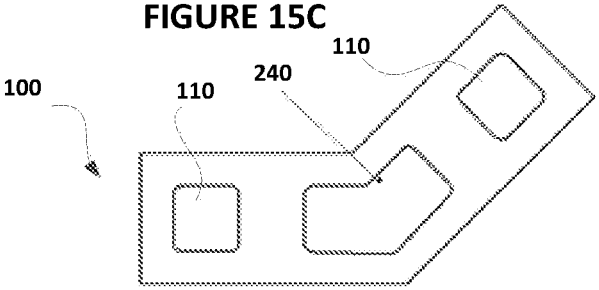
FIG. 15D is an underside view of the load bearing member of FIG. 15A.
Figure 15E:
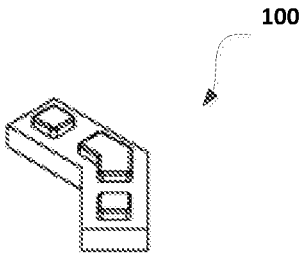
FIG. 15E is an isometric view of the load bearing member of FIG. 15A.
Figure 16A:
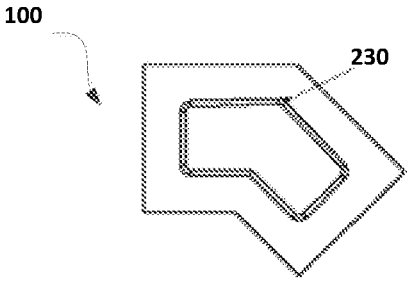
FIG. 16A is a plan view of a further example of a load bearing member.
Figure 16B:
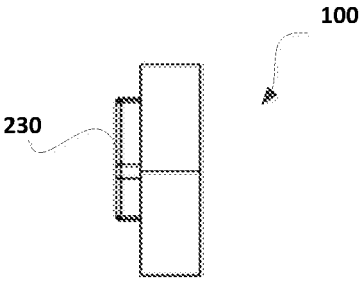
FIG. 16B is a side view of the load bearing member of FIG. 16A.
Figure 16C:
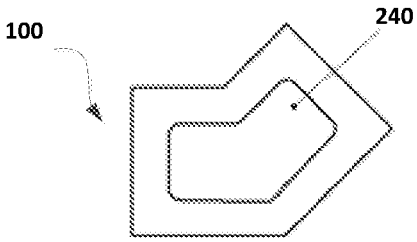
FIG. 16C is an underside view of the load bearing member of FIG. 16A.
Figure 16D:
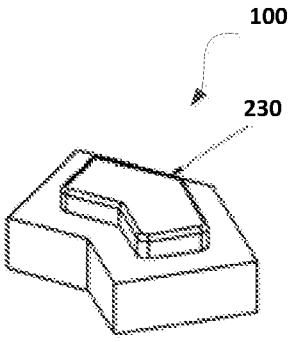
FIG. 16D is an isometric view of the load bearing member of FIG. 16A.
Figure 17A:
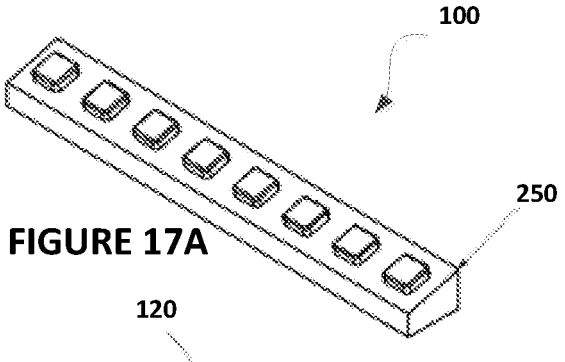
FIG. 17A is an elevated isometric view of a further example of a load bearing member.
Figure 17B:
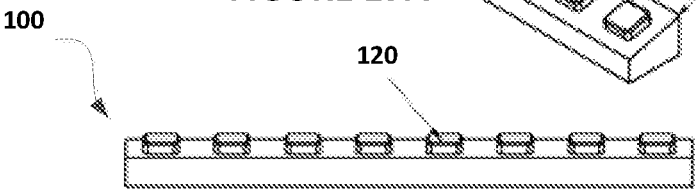
FIG. 17B is a side view of the load bearing member of FIG. 17A.
Figure 17C:
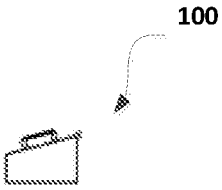
FIG. 17C is an end view of the load bearing member of FIG. 17A.
Figure 17D:
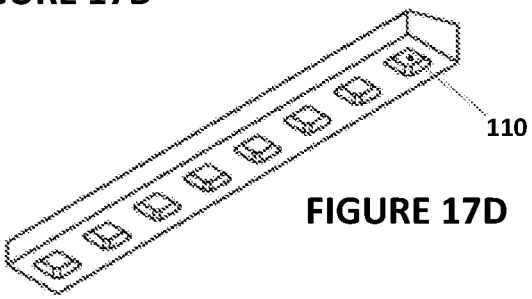
FIG. 17D is an underside isometric view of the load bearing member of FIG. 17A.

Referring to FIGS. 13A, 13B, 13C, 13D and 13E, the load bearing member 100 further includes a further protrusion 200, wherein the further protrusion 200 includes a circular cross-sectional profile to be received within a recess of an additional load bearing member 100. The circular cross-sectional profile of the further protrusion 200 enables the additional load bearing member 100 to be pivotable relative to the load bearing member 100 depicted by these figures due to the further protrusion 200 being able to rotate within a recess 210 of the additional member 100 as shown in FIG. 13D, wherein the recess 210 has a circular cross-sectional profile.

Referring to FIGS. 14A, 14B, 14C, 14D and 14E, the body of the member 100 includes a hole 220 passing therethrough to allow a pin (not shown) to join the load bearing member 100 to another structure. The hole 220 can be a round hole. The end of the body 105 which the hole 220 passes therethrough can include a rounded end.

Referring to FIGS. 15A, 15B, 15C, 15D and 15E, the body 105 of the load bearing member 100 can include a dog-leg profile. The dog-leg profile allows for connecting load bearing members to be angled at 45 degrees relative to each other. At least one of the protrusions 230 of the load bearing member 100 includes a dog-leg cross-sectional profile and wherein at least one of the recesses 240 of the load bearing member 100 includes a corresponding dog-leg profile. As shown in FIGS. 16A, 16B, 16C and 16D, the load bearing member 100 may only include a single protrusion and a single recess which both have a dog-leg profile.

Referring to FIGS. 17A, 17B, 17C and 17D, the protrusions 120 of the load bearing member 100 extend from a face 250 of the body 105 which is non-orthogonal relative to the axis of the respective recess. In particular, the body 105 has a trapezoidal cross-section, wherein the upper face 250 is not parallel to the base face of the body 105. The protrusions 120 of the member 100 extend orthogonally from the upper angled face 250 of the body 105. This upper face 250 can be angled at approximately 15 degrees relative to the base face.

Figure 18A:
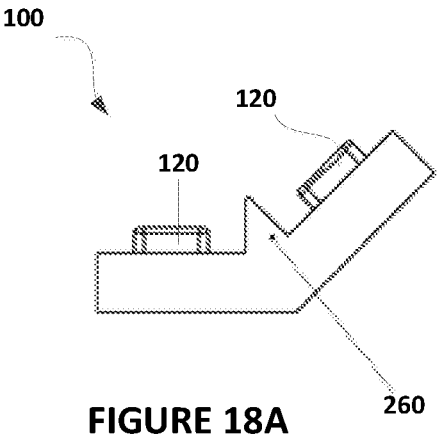
FIG. 18A is a plan view of a further example of the load bearing member.
Figure 18B:
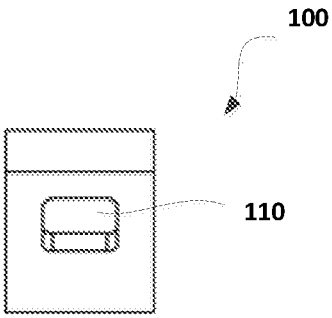
FIG. 18B is an end view of the load bearing member of FIG. 18A.
Figure 18C:
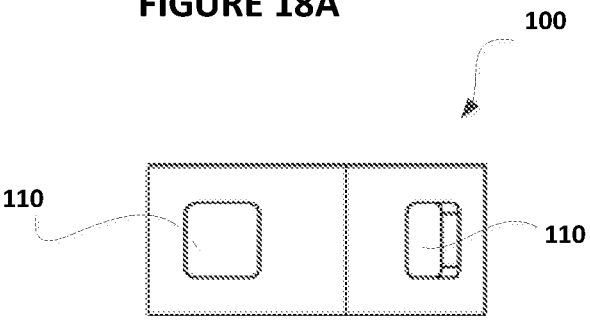
FIG. 18C is an underside side view of the load bearing member of FIG. 18A.

Referring to FIGS. 18A, 18B and 18C, in a further example, the body 105 of a load bearing member 100 includes a dog-leg cross-sectional profile. A separating stop protrusion 260 is located at the apex of the body 105 which provides a buttable surface for connecting members 100 to butt against. The separating stop protrusion 260 includes a triangular cross-sectional profile.

Figure 19A:
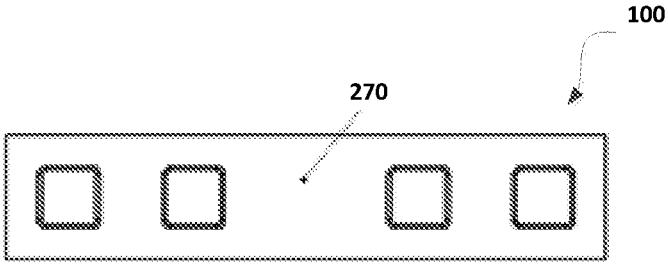
FIG. 19A is a plan view of a further example of a load bearing member.
Figure 19B:
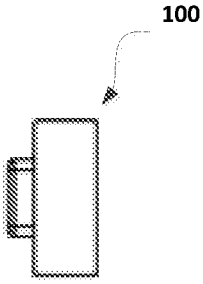
FIG. 19B is a side view of the load bearing member of FIG. 19A.
Figure 19C:
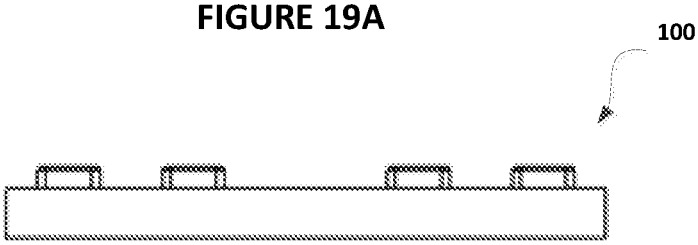
FIG. 19C is a side view of the load bearing member of FIG. 19A.
Figure 20A:
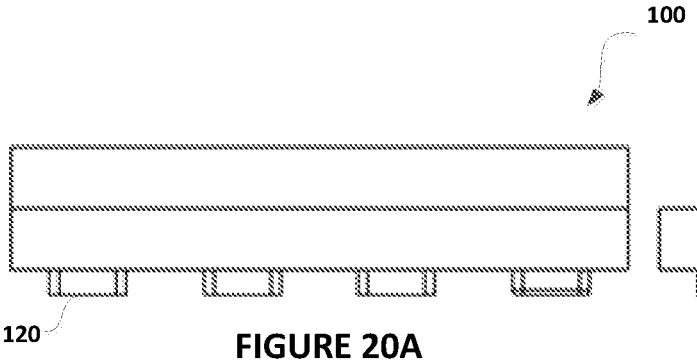
FIG. 20A is a side view of a further example of a load bearing member.
Figure 20B:
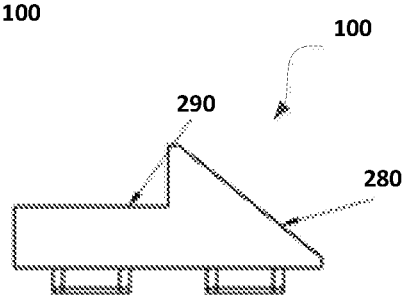
FIG. 20B is an end view of the load bearing member of FIG. 20A.
Figure 20C:
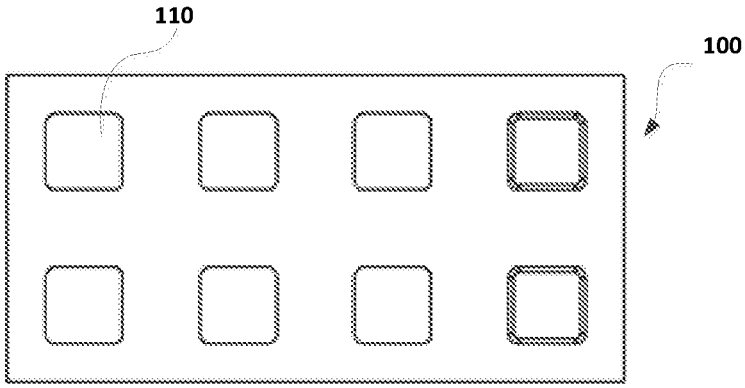
FIG. 20C is an underside view of the load bearing member of FIG. 20A.
Figure 20D:
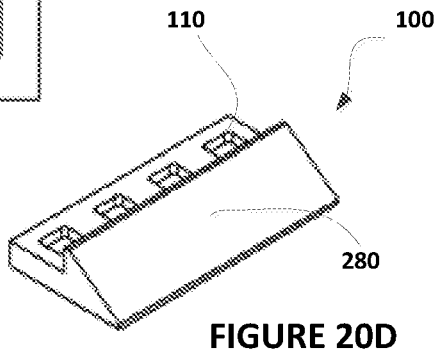
FIG. 20D is an isometric view of the load bearing member of FIG. 20A.
Figure 21A:
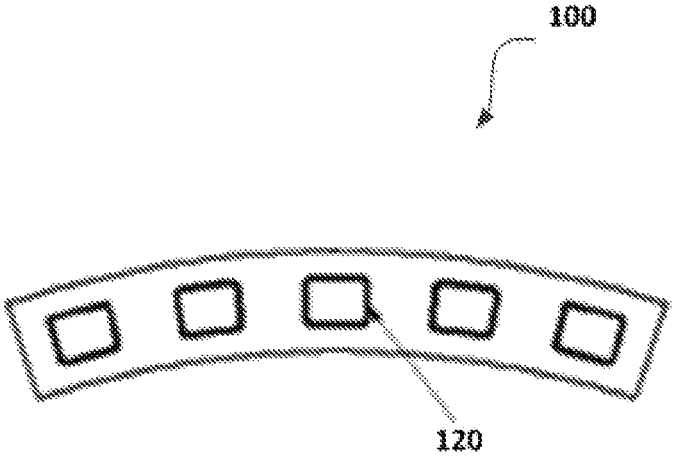
FIG. 21A is a plan view of a further example of a load bearing member.
Figure 21B:
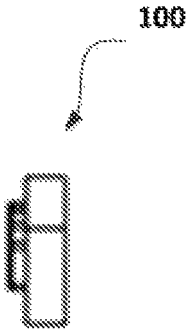
FIG. 21B is an end view of the load bearing member of FIG. 21A.
Figure 21C:
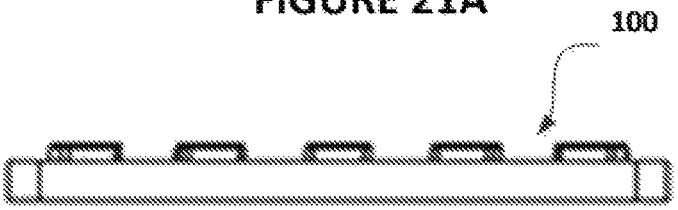
FIG. 21C is a side view of the load bearing member of FIG. 21A.
Figure 21D:
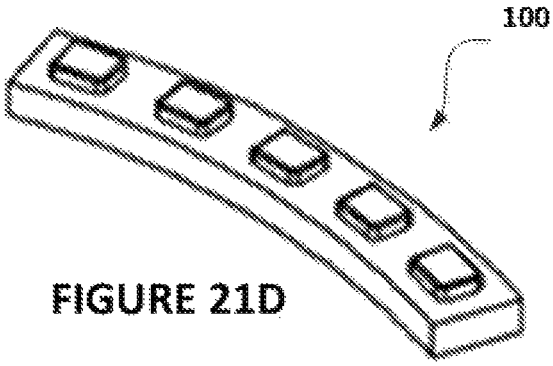
FIG. 21D is an isometric view of the load bearing member of FIG. 21A.

As shown in FIG. 2, the plurality of protrusions 120 which extend from the body 105 can be equally spaced relative to each other. However, as shown in FIGS. 19A, 19B and 19C, other examples of the load bearing member 100 can include non-uniform spacing 270 between neighbouring protrusions 120. For example, the separation between the first and second protrusions 120 is less than the separation 270 between the second and third protrusions 120.

Referring to FIGS. 20A, 20B, 20C and 20D, the body 105 can include a ramped face 280. This example of the body 105 has the protrusions 110 extending downwardly from a lower face of the body 105 and an upper face of the body 105 includes the recesses 110. As shown in these figures, an upper portion of the ramped face is elevated above an upper face 290 of the body 105. The member 100 shown in this example can be used for such applications where a wheeled device is rolled onto a load supporting platform, wherein the ramp 280 enables the wheel device to be rolled on the platform which connects with the recesses 110 provided in the upper face 290 of the body 105.

As shown in FIGS. 21A, 21B, 21C and 21D, in some examples of the load bearing member 100, the body 105 has an arc-profile.

Figure 22A:
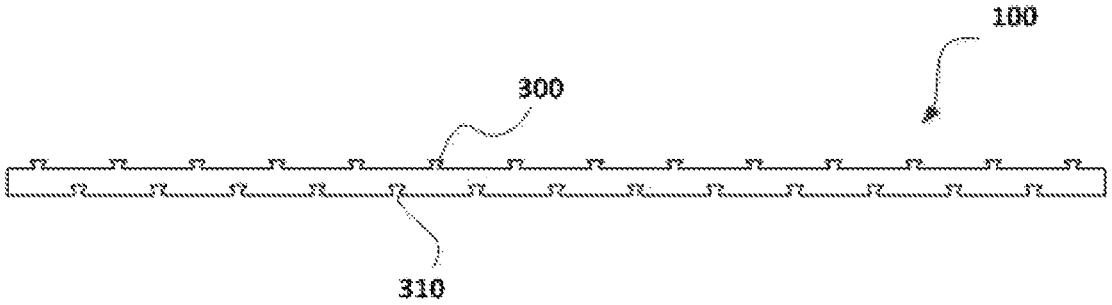
FIG. 22A is a side view of a further example of a load bearing member.
Figure 22B:
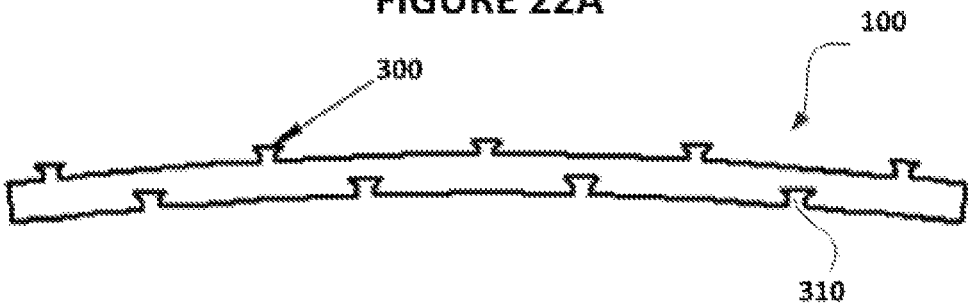
FIG. 22B is a side view of the load bearing member of FIG. 22A being flexed prior to connection with another load bearing member.
Figure 22C:
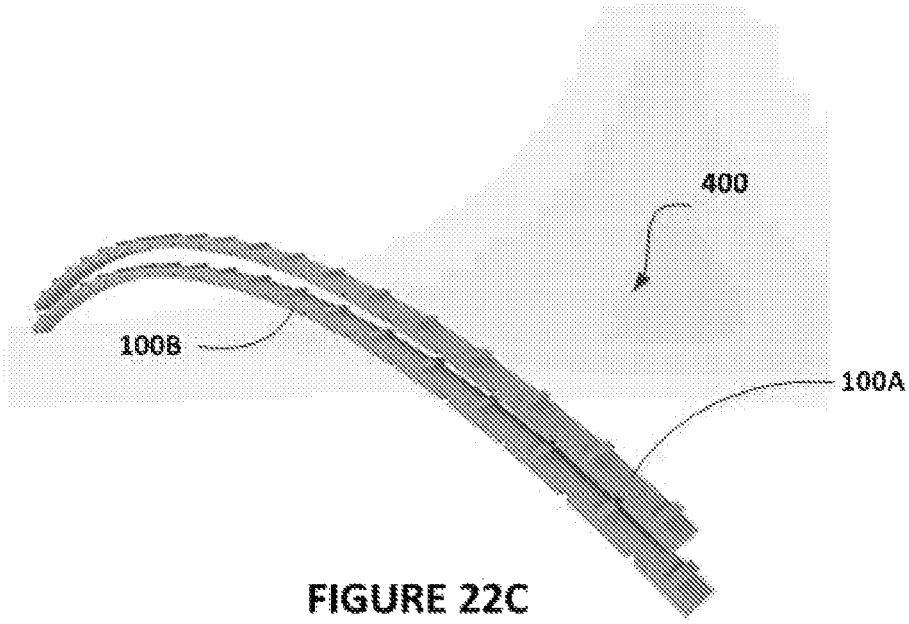
FIG. 22C is an perspective view of a pair of load bearing members being flexed to be connected together is a stacked arrangement such as to be secured together in a flexed profile.
Figure 23A:
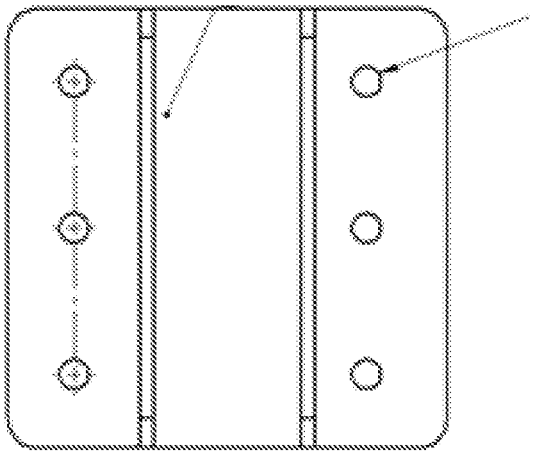
FIG. 23A is a front view of a bracket for coupling to one or more load bearing members.
Figure 23B:
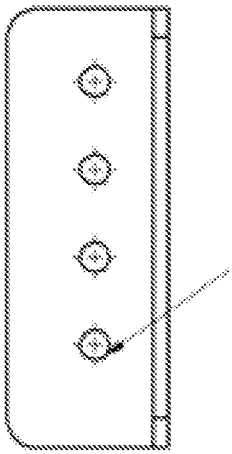
FIG. 23B is a side view of the bracket of FIG. 23A.
Figure 23C:
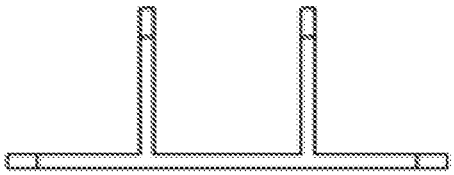
FIG. 23C is an plan view of the bracket of FIG. 23A.
Figure 23D:
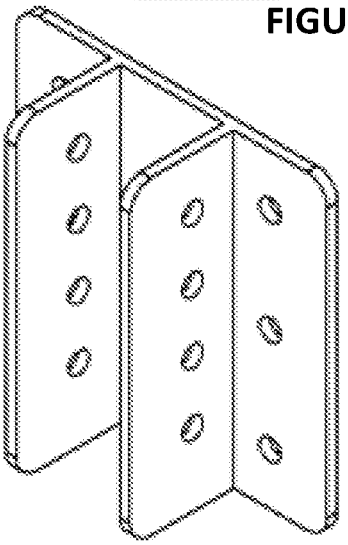
FIG. 23D is an isometric view of the bracket of FIG. 23A.
Figure 24A:
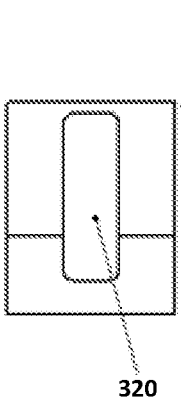
FIG. 24A is a rear view of an example of a connecting member.
Figure 24B:
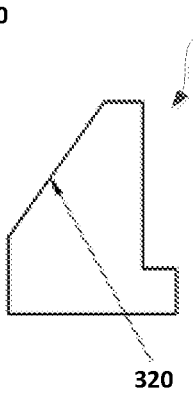
FIG. 24B is a side view of the connecting member of FIG. 24A.
Figure 24C:
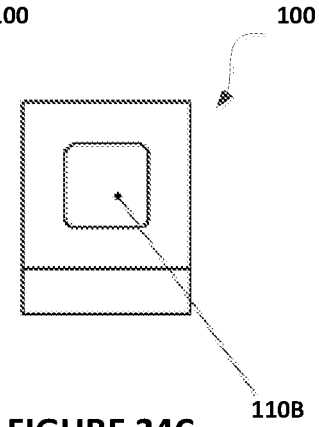
FIG. 24C is a front view of the connecting member of FIG. 24A.
Figure 24D:
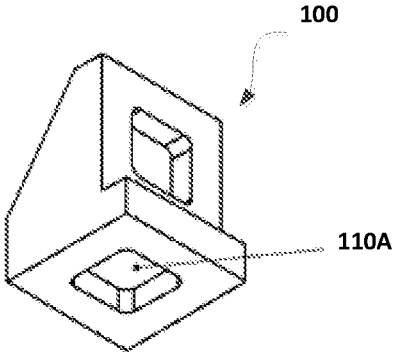
FIG. 24D is an underside isometric view of the connecting member of FIG. 24A.
Figure 25A:
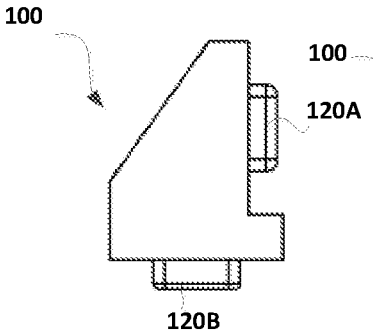
FIG. 25A is a side view of a further example of a connecting member.
Figure 25B:
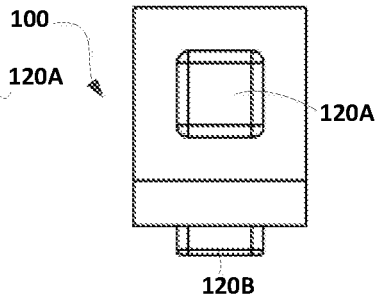
FIG. 25B is a front view of the connecting member of FIG. 25A.
Figure 25C:
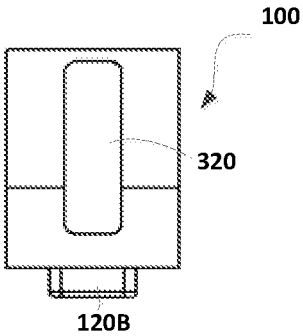
FIG. 25C is a rear view of the connecting member of FIG. 25A.
Figure 25D:
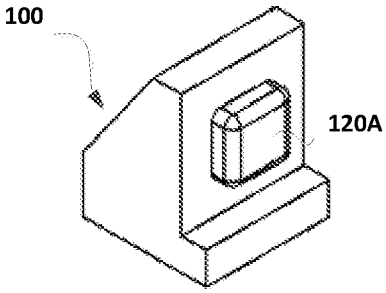
FIG. 25D is an isometric view of the connecting member of FIG. 25A.
Figure 26A:
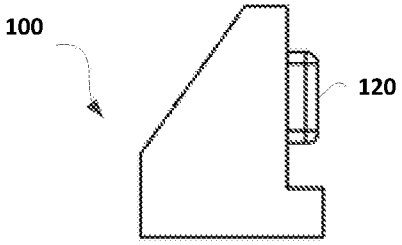
FIG. 26A is a side view of a further example of a connecting member.
Figure 26B:
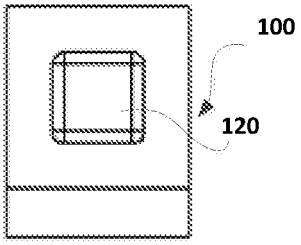
FIG. 26B is a front view of the connecting member of FIG. 26A.
Figure 26C:
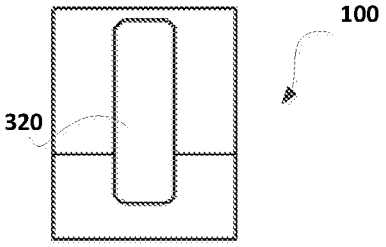
FIG. 26C is a rear view of the connecting member of FIG. 26A.
Figure 26D:
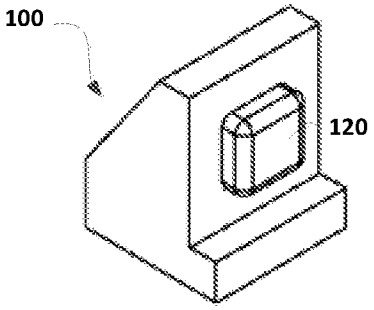
FIG. 26D is an isometric view of the connecting member of FIG. 26A.
Figure 27A:
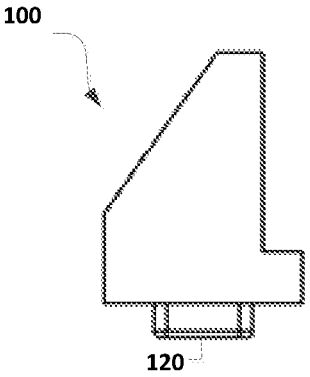
FIG. 27A is a side view of a further example of a connecting member.
Figure 27B:
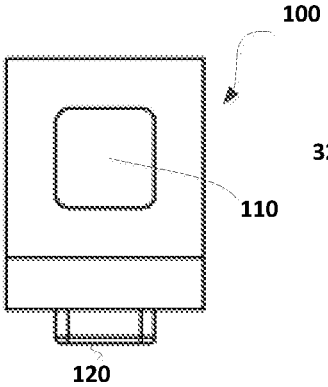
FIG. 27B is a front view of the connecting member of FIG. 27A.
Figure 27C:
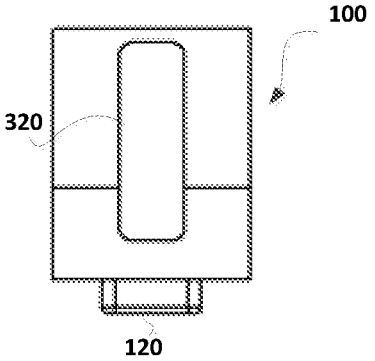
FIG. 27C is a rear view of the connecting member of FIG. 27A.
Figure 27D:
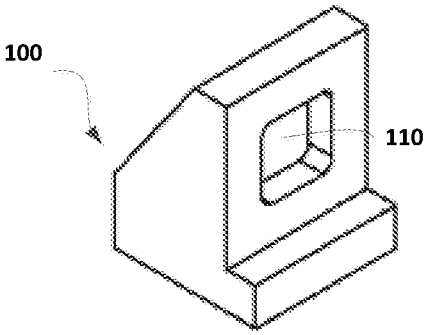
FIG. 27D is an isometric view of the connecting member of FIG. 27A.

Referring to FIGS. 22A, 22B and 22C there is shown a further example of a load bearing member 100. The load bearing member 100 is elongate and includes a plurality of protrusions 300 extending from the body 105 on one face and a plurality of recesses 310 extending within the body from a second opposing face. The spacing between neighbouring protrusions 300 is substantially equal and the spacing between neighbouring recesses 310 is substantially equal. As shown in FIG. 22C, a plurality of members 100A, 100B as shown in FIG. 22A can be interconnected together in a flexed configuration. Advantageously, the members 100A, 100B can be provided in a straight configuration and then flexed to interconnect. For example, the load bearing members 100A, 100B can be made off site and shipped to a site in a straight configuration, and then flexed on site to form the an arched load bearing structure 400 when interconnected. In order to achieve this, the spacing of the protrusions 300 for the lower member 100B is different to the spacing between recesses 310 of the upper member 100A to take into account the different amount of flexing required on the lower and upper faces of the respective load bearing members 100A, 100B. The members 100A, 100B are then flexed such that the protrusions 300 of the lower member 100B align with the recesses 310 of the upper member 100A so as to allow the protrusions 300 to be locatable with in the recesses 310 and form the load bearing structure 400 having an arched profile. In a preferable form, the plurality of protrusions 300 and the plurality of recesses 310 can be provided with a dove-tail profile such as to lock the members 100A, 100B together in the flexed configuration. This system for building a load bearing structure 400 is highly advantageous over prior art configurations where substantial amounts of force over significant periods of time are required to maintain the flexed profile for interconnected wooden members.

Referring to FIGS. 23A, 23B, 23C and 23D, there is shown an example of a bracket to couple the ends of the arched load bearing members 100A, 100B of structure 400 to another structure such as an orthogonal structure.

Referring to FIGS. 24A, 24B, 24C, and 24D, an example of a load bearing member in the form of a connecting member is shown which includes a first recess 110A extending within the body 105 in a first direction, and a second recess 110B extending with the body 105 in an orthogonal direction to the first recess 110A. The multiple recesses 110A, 110B in different directions allows for members 100 extending in orthogonal directions to be connected together. The body 105 can include a top portion having a substantially triangular or trapezoidal profile. The angled face of the top portion of the body 105 can include a channel 320 which allows for a fastener to protrude through the connecting member 110 to allow the connecting member 100 to be secured to another member 100. Similarly, FIGS. 25A, 25B, 25C, and 25D show a different example of the connecting member 100 which includes a first protrusion 120A extending from the body 105 in a first direction, and a second protrusion 120B extending from the body 105 in an orthogonal direction to the first protrusion 120A. FIGS. 26A to 26D and FIGS. 27A to 27D show alternate examples of the connecting member 100 where the recess 110 and the protrusion 120 extend in/from the body in orthogonal directions relative to each other.

Figure 28:
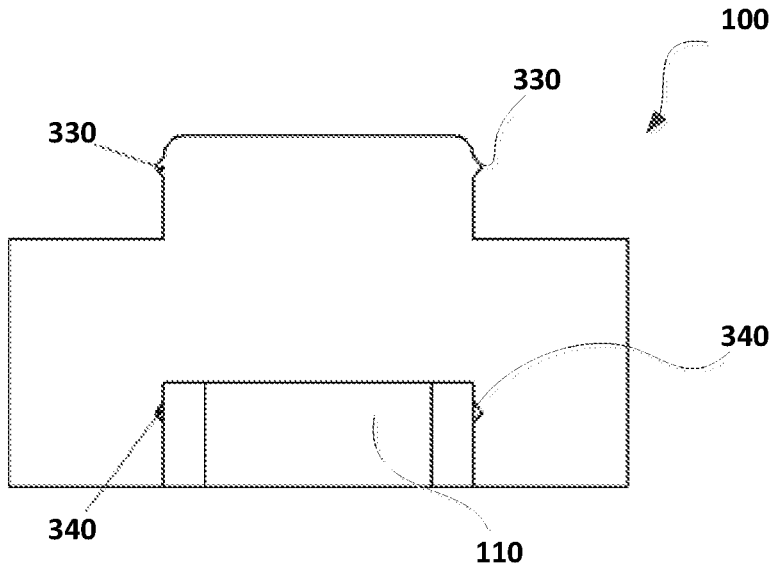
FIG. 28 is a cross-sectional view of a further example of a load bearing member including a locking arrangement.

Referring to FIG. 28 there is shown a cross-sectional view of an example of the load bearing member 100 which includes a recess 110 and a protrusion 120. Side walls of the protrusion include one or more smaller protrusions 330 such as one or more ridges that can extend laterally from the side walls around the perimeter of the protrusion 120. However, it will be appreciated that the one or more ridges 330 do not necessarily need to extend around the entire perimeter and may only be provided on some of the faces of the protrusion 120. The one or more ridges 330 can extend outwardly from the side wall approximately three-quarters of the length of the side wall from the upper surface of the body 105. Inner side walls of the recess 110 include a corresponding further recess(es) 340 which can be provided in the form of one or more notches. The one or more notches 340 can extend around the perimeter of the inner wall of the recess 110 although it will be appreciated that the one or more notches 340 do not necessarily need to extend around the entire perimeter of the inner walls of the recess 110 and may only be provided on only some of the inner walls of the recess 110. When the protrusion 120 of one load bearing member 100 is received within the recess 110 of another load bearing member 100, the protrusion 120 is tight fittingly received within the recess 110. Due to the small size of the ridge 330 and the resilient nature of the wooden material of the load bearing members 100, the ridge 330 can slightly compress when the protrusion 120 is inserted into the recess 110 and pressed therein. The protrusion 120 continues to be pressed within the recess 110 until each ridge 330 aligns with the corresponding notch 340 causing each ridge 330 to expand into the aligned notch 340 thereby frictionally locking and securing the load bearing members 100 together. The ridge and notch arrangement 330, 340 provides additional resistance against the load bearing members 100A, 100B being disassembled.

Figure 29:
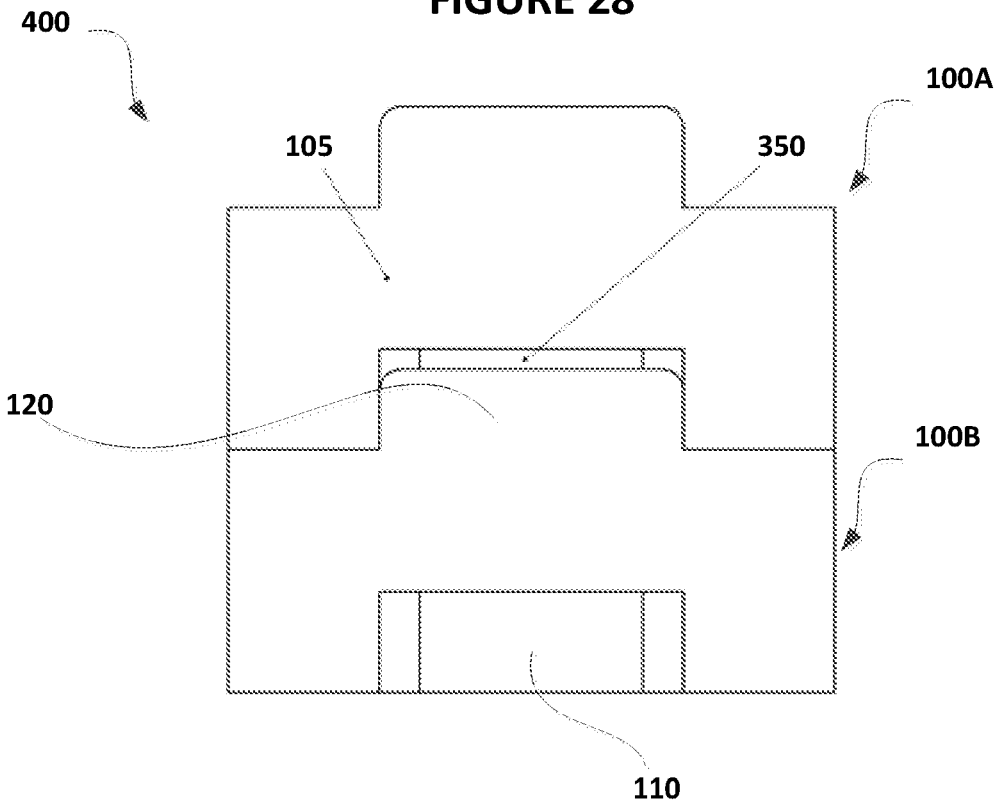
FIG. 29 is a cross-sectional view of examples of connected first and second load bearing members forming a load bearing structure.

Referring to FIG. 29 there is shown a first and second load bearing member 100A, 100B in a connected arrangement where the protrusion 120 of the second load bearing member 100B is located within the recess 110 of the first load bearing member 100A. In this embodiment, the first member acts as a safety member which provides a visual indication for if the structure is approaching failure. As can be seen in FIG. 29, the recess 110 is of the first load bearing member 100A is deeper than the height of the protrusion 120 of the second load bearing member 100B such that the when the protrusion 120 is inserted completely into the recess 110, a cavity 350 is located between the upper surface of the protrusion 120 and the end (roof) wall of the recess 110. The cavity 350 provides a lower yield support. The lower height of the protrusion 120 provides a stress concentration around the recess 110. This stress concentration contributes to a controlled yield of the load bearing member 100. This cavity 350 is a safety feature to provide a visual indicator for determining if the load bearing structure 400 is insufficient to support the compressive load, particularly when an amount of the compressive load is difficult to predict. The predictable yield of the load bearing member 100 with this safety feature provides the operator with a visual indicator in relation to whether the compressive load needs extra support.

In the event that the load bearing structure 400 is insufficient to support the compressive load, the roof surface of the recess 110 will sag under the compressive load causing the load bearing member 100 to compress. This compression of the roof surface of the recess 110 provides a measurable visual indicator which allows for monitoring of the load bearing structure 100. This is highly advantageous over previous systems for building load bearing structures where there is generally no visual indicator that the load bearing structure is nearing failure, thus only complete failure of the load bearing structure provides a visual indicator which is clearly inappropriate. A dimension of the load bearing structure 400 may be monitored and measured over time whilst supporting the compressive load to determine if one or more of the safety members 100A have compressed to a point indicating that the load bearing structure 400 is nearing failure. This dimension can then be compared against a threshold to determine whether the load bearing structure is nearing failure. Such a dimension may be a distance between two reference points on the load bearing structure wherein the measured distance passes through the one or more cavities defined by the connected members.

Figure 34A:
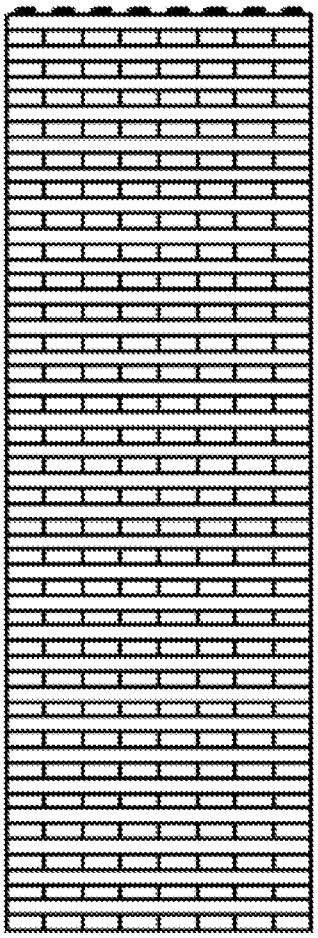
FIG. 34A is a front view of an example of a load bearing structure below a critical load.
Figure 34B:
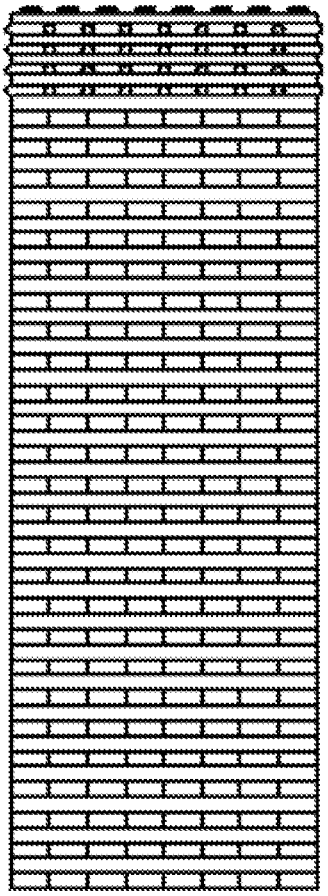
FIG. 34B is a front view of the same example of a load bearing structure as in FIG. 34A above a critical load.

These safety members are preferably installed at the top of the load bearing structure, providing a known location of first failure within the structure, as well as a standard location for visual inspection of the structure. FIG. 34 shows a structure consisting of a plurality of members with a series of safety members located at the top of the structure. FIG. 34A shows the structure under a standard load and FIG. 34B shows a condition wherein an excessive load is applied, resulting in a predictable yield in the safety members towards the top of the structure.

In some embodiments, the system includes a metal stiffener sheet which includes one or more of holes to receive therethrough the one or more protrusions of a load bearing member to be connected to another load bearing member. The metal stiffener sheet is sandwiched between the bodies of the interconnected load bearing members to provide additional strength to the load bearing structure. The metal stiffener can be made from steel. The steel provides extra tensile strength. The extra tensile strength is important in the application of laminated beams.

Figure 30:
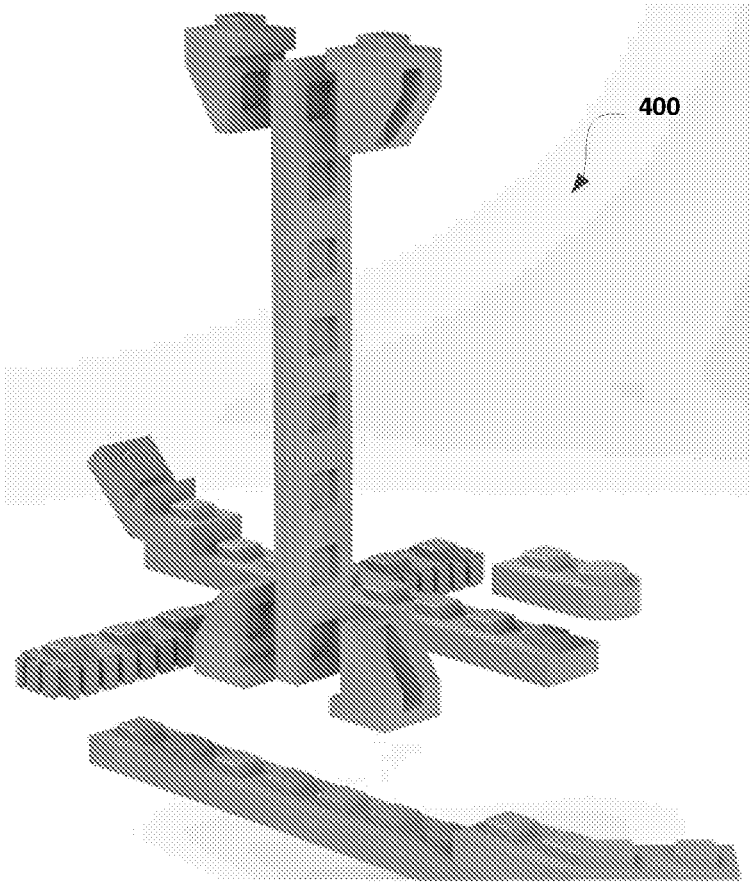
FIG. 30 is a perspective view of examples of a plurality of load bearing members for interconnection to form a load bearing structure.
Figure 31:
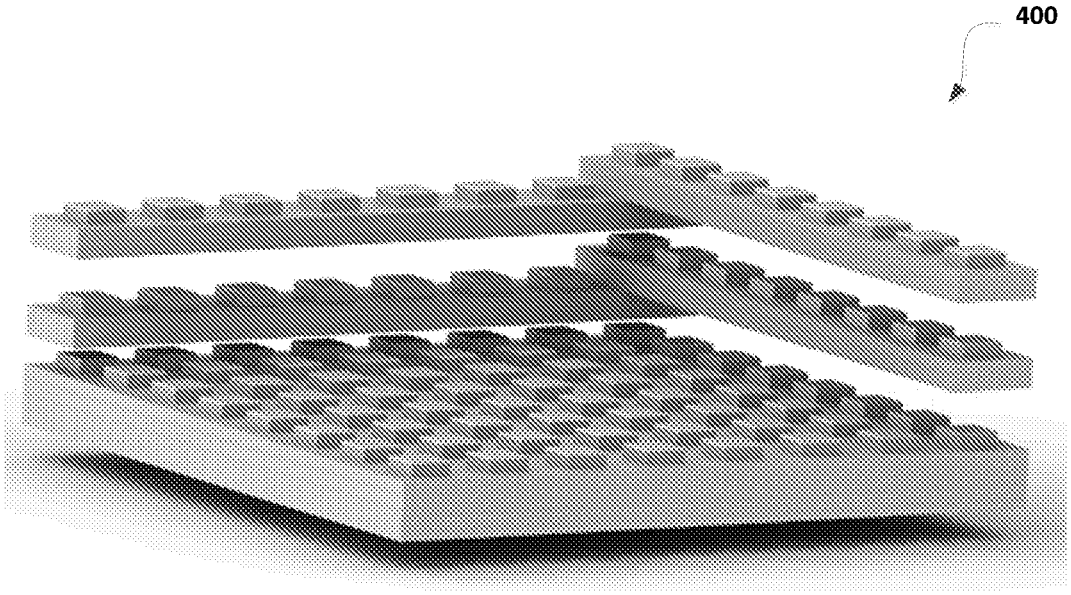
FIG. 31 is a perspective view of an example load bearing structure including a plurality of interconnected load bearing members.
Figure 32:
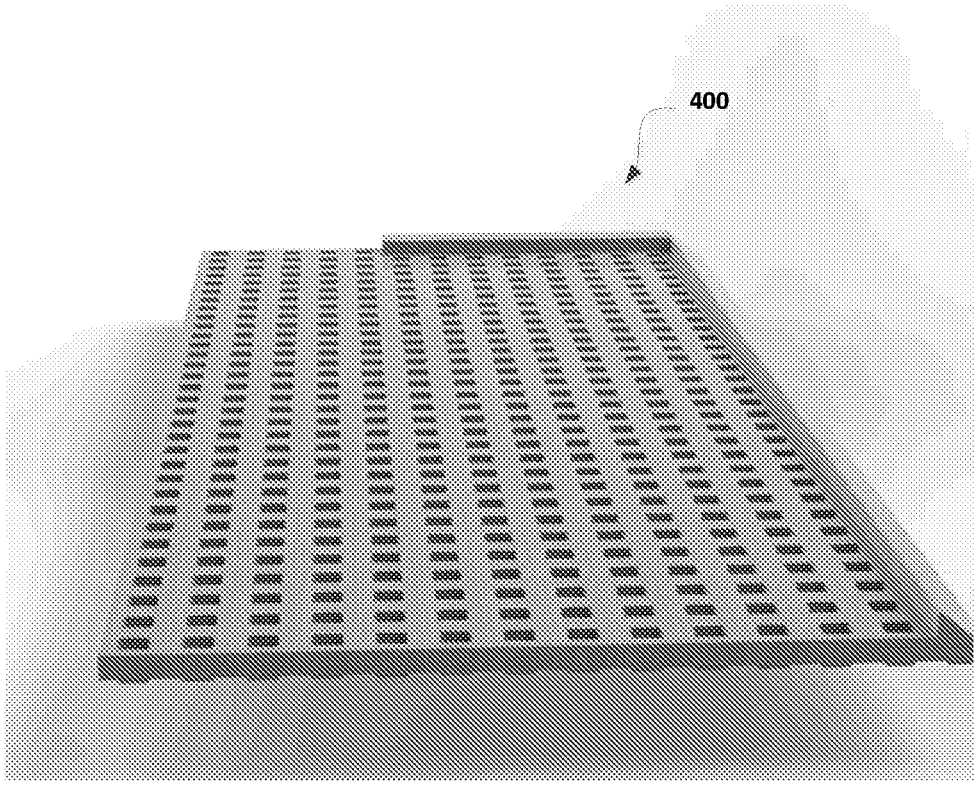
FIG. 32 is a perspective view of a further example of a load bearing member including a plurality of projections.

Referring to FIGS. 30, 31 and 32 there is shown a variety of different load bearing structures 400 that can be formed using the variety of load bearing members 100 discussed above. In FIGS. 31 and 32 there is shown a load bearing member 100 provided in the form of a sheet which provides a matrix of protrusions 120 extending from the body on one face and on the opposing face of the body of the sheet there is provided a plurality of recesses 110. Such members 100 may be useful for building load bearing structures 400 such as floors or the like.

Figure 4:
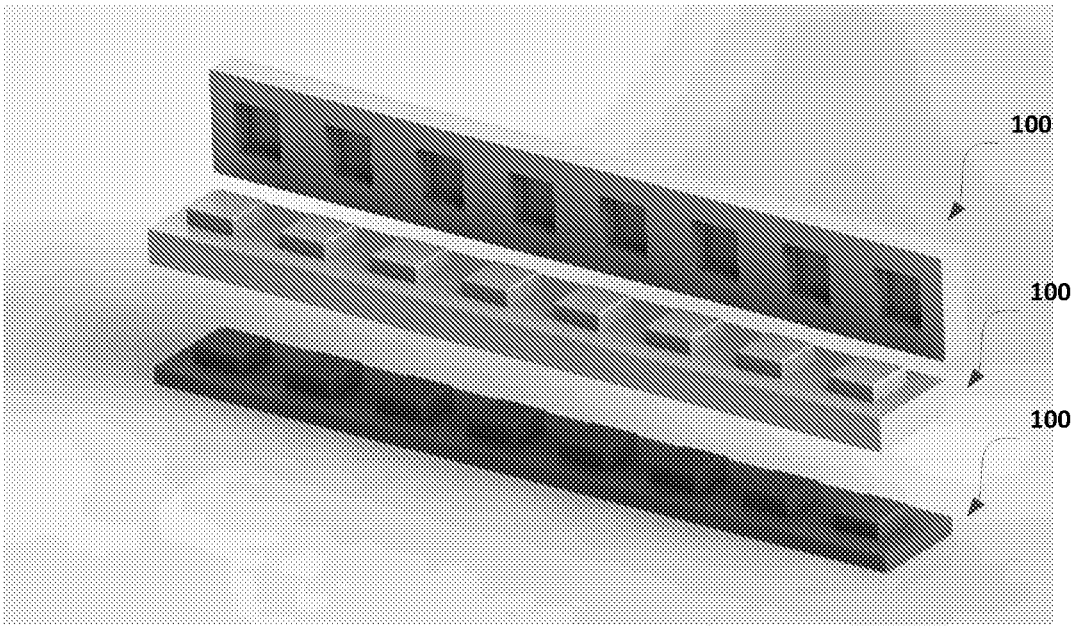
FIG. 4 is an isometric view of an example of three load bearing members made of different materials in the process of being connected together.

As shown in FIG. 4, different load bearing members 100 can be coupled together which are made from different materials.

It will be appreciated that due to the load bearing members 100 being made from timber, it is possible for the load bearing members 100 to be cut to size as required for the particular application on site using a saw or the like. In one embodiment there may be provided one or more grooves, such as small 'v' grooves, on a bottom face of the load bearing member marking gap between neighbouring aligned protrusions and recesses. This 'v' groove provides an accurate guide for cutting the load bearing member to size.

The above described system for building a load bearing structure 400 provides a number of advantages. In particular, this system provides for much stronger structures in the same uses as traditional dunnage. The interlocking geometries provide the opportunity to use less material for the same level of support. Furthermore, the system allows for standardisation of small support structures. The modular nature allows for ready reckoner style tables for design of common structures. For example if a job requires a load capacity of 25 tons at 1.2 m high an operator could use a table to quickly understand than build a structure to meet those requirements. Additionally, the interlocking geometries provide a greater range of load bearing flexibility. In the event that a traditional dunnage structure is used, and the load is applied at an angle that is less than normal to the pieces the load bearing of the invention would be much higher with the same amount of material. Furthermore, there are several structures that are possible using the invention that are not possible with the traditional dunnage. Additionally, the modular nature allows many structures to be transported more efficiently. Due to the wide number of applications for the system, a smaller amount of inventory is required to cover a larger amount of tasks reducing the need for inventory and the waste on materials, labour and other inputs. Furthermore, the load bearing structures and the system provide a much higher level of safety. The interface between the protrusion and the recess allows for crossing of the grains to provide high tensile strength in two directions. Furthermore, when loads are encountered in the field, the load bearing surfaces and the vector angle of the forces may not be known. The team would need to have a large selection of materials to cover all the possible situations or incur a lead time delay while the materials are procured. In contrast, the described system seeks to overcome such deficiencies.

Many modifications will be apparent to those skilled in the art without departing from the scope of the present invention.

The reference in this specification to any prior publication (or information derived from it), or to any matter which is known, is not, and should not be taken as, an acknowledgement or admission or any form of suggestion that prior publication (or information derived from it) or known matter forms part of the common general knowledge in the field of endeavour to which this specification relates.

Throughout this specification and the claims which follow, unless the context requires otherwise, the word "comprise", and variations such as "comprises" or "comprising", will be understood to imply the inclusion of a stated integer or step or group of integers or steps but not the exclusion of any other integer or step or group of integers or steps.

The invention claimed is:

1. A system for building a load bearing structure for supporting a compressive load, the system including a plurality of wooden members including:

a first member including a first body having a recess therein;

a second member including a second body having protrusion extending therefrom; and a third member including a third body having a recess therein;

wherein the protrusion of the second member is locatable within the recess of the first or third member to interconnect the first and second or third and second members together to form the loading bearing structure, wherein the protrusion is not rotatable within the recess, and;

wherein the third member has a recess with a depth greater than a height of the protrusion of the second member such that a cavity is formed between an upper inner wall of the third member and a top portion of the protrusion of the second member when the second and third members are interconnected, the cavity provides a stress concentration around the recess;

wherein, when the load bearing structure is sufficient for supporting the load a distance between the upper inner wall of the third member and the top portion of the protrusion of the second member will remain constant, and when the load bearing structure is insufficient for supporting the load a distance between the upper inner wall of the third member and the top portion of the protrusion of the second member will be compressed.

2. The system according to claim 1, wherein at least one of the first and third bodies has extending therefrom a protrusion, the second body includes a recess.

3. The system according to claim 2, wherein the protrusion of at least one of the first and third bodies extend in a direction substantially parallel to a longitudinal axis of the recess.

4. The system according to claim 2, wherein the recess of the second body extends in a direction substantially parallel to a direction which the protrusion extends from the second body.

5. The system according to claim 2, wherein a top portion of the protrusions of the first, second and third members include a hole extending therethrough to the respective recess to allow a fastener to fasten the first member to the second member via aligned holes when the first and second member are interconnected.

6. The system according to claim 2, wherein the protrusion of the second member extends from a face of the second body which is not substantially parallel relative to an axis of a respective recess.

7. The system according to claim 1, wherein one or more side walls of the protrusion of the second member include a ridge and wherein one or more inner side walls of the recess include a notch, wherein the ridge is engaged within the notch when the protrusion of the second member is located within the recess of the first or third member to secure the first and second or third and second members together.

8. The system according to claim 1, wherein the cavity enables monitoring of a dimension of the second and third members under load to determine if the load bearing structure is sufficient for supporting the load.

9. The system according to claim 1, wherein the protrusion of the second member and the recesses of the first and third members have a substantially quadrilateral cross-sectional profile.

10. The system according to claim 9, wherein the quadrilateral cross-sectional profile is a substantially square profile.

11. The system according to claim 1, further including a side hole in a side wall of the first body to enable a fastener to protrude through the side hole and into the protrusion of the second member received within the recess of the first body to thereby secure the first member to the second member.

12. The system according to claim 1, wherein a height of the protrusion of the second member is approximately half a height of the second body.

13. The system according to claim 1, wherein a depth of at least one of the recesses of the first and third members is approximately half a height of the first body.

14. The system according to claim 1, wherein an outer side of the first or second member includes a T-slot interface to enable interlocking with a further member having a corresponding T-slot interface.

15. The system according to claim 1, wherein the second member further includes a further protrusion, wherein the further protrusion includes a circular cross-sectional profile to be received within a recess of an additional wooden member, wherein the additional wooden member is pivotable relative to the second member due to the further protrusion being able to rotate within the recess of the additional wooden member.

16. The system according to claim 1, wherein the second body of the second member includes a hole passing therethrough to allow a pin to join the second member to another structure.

17. The system according to claim 1, wherein the first body or second body include a ramped face.

18. The system according to claim 1, wherein the first body includes a further recess extending therein in a direction orthogonal to the recess.

19. The system according to claim 1, wherein the second body includes a further projection extending in a direction orthogonal to the projection.

20. The system according to claim 1, wherein the first body of the first member and the second body of the second member are elongate, wherein the first body includes a plurality of recesses extending therein in a common direction, and wherein the body of the second member includes a plurality of protrusions extending from the second body in a common direction.

21. The system according to claim 20, wherein at least one of the first and second body of at least one of the first and second members includes a dog-leg profile.

22. The system according to claim 21, wherein at least one of the protrusions of the second member includes a dog-leg cross-sectional profile and wherein at least one of the recesses of the first member includes a corresponding dog-leg profile.

23. The system according to claim 1, wherein the first and second body of the first and second wooden members has an arc-profile.

24. The system according to claim 1, wherein the first member is elongate and includes a plurality of protrusions extending from the first body, and wherein the second member is elongate and includes a plurality of recesses extending within the second body, wherein a spacing between neighbouring protrusions is substantially equal, wherein a spacing between neighbouring recesses is substantially equal, wherein the first and second bodies are flexible to align the plurality of protrusions with the plurality of recesses so as to allow the protrusions to be locatable with in the recesses and form the load bearing structure having an arched profile.

25. The system according to claim 24, wherein the plurality of protrusions and the plurality of recesses have a dove-tail profile.

* * * * *